US005804095A

United States Patent [19]

Jacobs et al.

[11] Patent Number: 5,804,095

[45] Date of Patent: Sep. 8, 1998

[54] MAGNETORHEOLOGICAL FLUID COMPOSITION

[75] Inventors: Stephen David Jacobs, Pittsford, N.Y.; William Kordonski; Igor Victorovich Prokhorov, both of Minsk, Belarus; Donald Golini, Rochester, N.Y.; Gennadii Rafailovich Gorodkin, Minsk, Belarus; Tvasta David Strafford, Rochester, N.Y.

[73] Assignees: Byelocorp Scientific, Inc., New York; University of Rochester, Rochester, both of N.Y.

[21] Appl. No.: 761,994

[22] Filed: Dec. 12, 1996

Related U.S. Application Data

[62] Division of Ser. No. 543,426, Oct. 16, 1995.

[51] Int. Cl.[6] ..... H01F 1/44; H01F 1/02

[52] U.S. Cl. ..... 252/62.52; 252/62.54; 51/304; 106/3

[58] Field of Search ..... 252/62.52, 62.54; 106/3; 51/304

[56] References Cited

U.S. PATENT DOCUMENTS

| | | | |
|---|---|---|---|
| 2,883,809 | 4/1959 | Simjian | 51/281 |
| 4,057,939 | 11/1977 | Basi | 51/281 R |
| 4,175,930 | 11/1979 | Sakulevich et al. | 51/281 R |
| 4,186,528 | 2/1980 | Yascheritsyn et al. | 51/161 |
| 4,974,368 | 12/1990 | Miyamoto et al. | 51/55 |
| 5,076,026 | 12/1991 | Mizuguchi et al. | 51/317 |
| 5,449,313 | 9/1995 | Kordonsky et al. | 451/35 |

FOREIGN PATENT DOCUMENTS

| | | |
|---|---|---|
| WO 94/04313 | 3/1994 | WIPO . |
| WO 94/10693 | 5/1994 | WIPO . |

OTHER PUBLICATIONS

T. Kurobe et al., "Magnetic Field–Assisted Fine Finishing", *Precision Engineering*, vol. 6, No. 3, pp. 119–124 (1984).

Hamaguchi, T., "Hydrostatic float polishing for wafer preparation," *Rev. Sci. Instrum.*, vol. 55, No. 11 (Nov. 1984), pp. 1867–1868.

*Primary Examiner*—Melissa Bonner
*Attorney, Agent, or Firm*—Kenyon & Kenyon

[57] ABSTRACT

A magnetorheological fluid comprises non-colloidal magnetic particles, an abrasive, water, glycerol, and an alkaline buffer. The abrasive may be $CeO_2$, the non-colloidal magnetic particles may be carbonyl iron, and the alkaline buffer may be $Na_2CO_3$. The fluid is useful for magnetorheological finishing.

1 Claim, 18 Drawing Sheets

Flow direction

MAGNETORHEOLOGICAL FLUID COMPOSITION

FIELD OF THE INVENTION

The present application is a divisional application of pending Ser. No. 08/543,426, filed Oct. 16, 1995. This invention relates to a method and apparatus for finishing employing magnetorheological fluids and the fluid compositions used therein.

BACKGROUND OF THE INVENTION

Processes for finishing a workpiece such as an optical lens generally comprise removing material at the surface of the workpiece to accomplish three objectives: (1) removal of subsurface damage, (2) surface smoothing, and (3) figure correction. Many known polishing processes can achieve objectives (1) and (2), but have difficulty achieving objective (3). Examples of such processes include full aperture contact polishing on pitch laps or on polyurethane laps. These processes are generally inefficient and often require many iterations to correct the figure of an optical lens. Other techniques such as ion beam milling can achieve objective (3), but are not effective in meeting objectives (1) and (2). Ion beam milling cannot smooth, and has been shown to introduce subsurface damage if not precisely controlled.

Finishing of precision optics typically requires the production of a surface that conforms to the desired figure to within 0.50 micron peak-to-valley. Finishing of optics typically requires relatively high rates of material removal, even with hard materials such as glass. Finishing of optics also typically requires sufficient material removal to eliminate subsurface damage from previous grinding operations and achieve a microroughness of 20 Å rms or less.

Conventional finishing processes employ precisely shaped, viscoelastic pitch or polyurethane foam-faced laps to transfer pressure and velocity through an abrasive slurry to the workpiece. The lap is large enough to cover the entire optically useful portion of the lens and is therefore termed a full aperture lap. The working surface of the finishing tool must conform to the desired workpiece surface. If the viscoelastic finishing tool is compliant, as would be the case for a tool made from pitch, rosin, or wax, it deforms under the influence of pressure and heat generated during the finishing process. The finishing tool loses the desired surface shape and assumes the surface shape of the actual workpiece, which is not yet corrected. Surface smoothing may continue, but the ability of the tool to further correct the surface figure is severely diminished. The finishing tool must be reshaped against a metal template possessing the desired surface shape before finishing is resumed. This iterative process is unpredictable and time consuming. It requires highly skilled craftsmen or master opticians. It also requires an inventory of metal templates including one for each workpiece shape.

Alternately, a viscoelastic finishing tool may be less compliant, as in the case of a tool made from a hard, thin polyurethane pad mounted on a metal backing template. This type of finishing tool is better at maintaining the desired shape during the finishing process, but it wears away with time, causing removal rates to diminish. As the tool's ability to smooth the workpiece surface is degraded it becomes difficult to achieve the required levels of surface smoothness. A master optician must periodically stop, redress or replace the pad, an(i then continue the finishing process.

All conventional full aperture, viscoelastic finishing tools suffer from the problem of embedded particulate material..

Glass shards and/or abrasive polishing grains become embedded in the tool surface with time. The surface may glaze over and become smooth. This reduces removal rates. Alternately, the embedded particulate material may scratch the workpiece surface, damaging the workpiece in the final stages of finishing. This form of tool degradation is unpredictable. For these reasons, finishing complex surfaces is complicated and difficult to adapt to large-scale production.

Some finishing processes make use of a sub-aperture lap, i.e. a finishing tool that is smaller than the portion of the workpiece that requires finishing. See, e.g., U.S. Pat. No. 4,956,944 to Ando et al. However, such processes make use of solid finishing tools and therefore suffer from many of the same problems as processes that use full sized laps.

Certain milling processes, including processes that use solid tools and processes that use ion beam bombardment, may also make use of a sub-aperture lap. While such processes are capable of shaping or figuring a workpiece, they cannot perform surface smoothing and indeed may cause surface roughness by exposing subsurface damage.

It is known to use fluids containing magnetic particles in polishing applications. U.S. Pat. No. 4,821,466 to Kato et al. discloses a polishing process in which a "floating pad" immersed in a fluid containing colloidal magnetic particles is pushed against a workpiece by buoyancy forces caused by the application of a nonuniform magnetic field. This polishing process has a rudimentary capability for figure correction which is similar to that used with full aperture, viscoelastic finishing tools. The shape of the float and the shape of the magnetic field must be custom tailored to achieve a specific desired surface shape. To finish another shape with the same process requires different lapping motions, as well as the design and fabrication of a different float and possibly a different magnet configuration. Substantial process and machine modifications are therefore required in order to change optic shapes.

It is also known to polish a workpiece by immersing it in a fluid containing magnetic particles and applying a rotating magnetic field to the fluid. See, e.g., U.S. Pat. No. 2,735,232 to Simjian. The rotating field is said to cause the fluid to flow circularly around the workpiece thereby polishing it. This method suffers from the disadvantage that it does not create sufficiently high pressure on the workpiece and therefore does not achieve a satisfactory material removal rate. It is also not possible to substantially correct surface figure errors to optical requirements with this method.

OBJECTS AND SUMMARY OF THE INVENTION

In light of the foregoing, it is an object of the invention to provide an improved finishing method and apparatus employing a magnetorheological fluid. It is a further object of the invention to provide a magnetorheological fluid for use in said method and apparatus.

It is a further object of the invention to provide a finishing system that can be used in finishing of optics.

It is a further object of the invention to provide a finishing system that provides a high degree of smoothing in that it both creates substantially no surface or subsurface damage (scratches, cracks, or subsurface cracks) and substantially eliminates existing surface and subsurface damage.

It is a further object of the invention to provide a finishing system that provides for both surface smoothing and figure correction.

It is a further object of the invention to provide a finishing system that may be easily automated and that is flexible in its applications.

It is a further object of the invention to provide a means for automating said system.

It is a further object of the invention to provide a finishing system that operates at a relatively high removal rate for a variety of materials.

It is a further object of the invention to provide a finishing system that smoothes the surfaces of a wide variety of materials to accepted standards of precision optics.

It is a further object of the invention to provide a finishing system whose removal rates may be accelerated for hard materials like silicon or especially hard materials like sapphire with the addition of nanocrystalline diamond abrasives to the standard MR fluid composition, or to otherwise optimized MR fluid compositions.

It is a further object of the invention to provide a finishing system wherein the finishing tool self-adjusts to any workpiece surface form—whether convex, concave, or flat—without requiring any changes to the structure of the finishing machine such as replacement of precisely shaped laps.

It is a further object of the invention to provide a finishing system wherein the finishing tool is represented by a removal function in the form of a finishing spot.

It is a further object of the invention to provide a finishing system comprising a magnetorheological fluid that is resistant to degradation under operating conditions of heat, abrasion and exposure to air.

These and other objectives are achieved by a MR finishing method and apparatus in accordance with the present invention. The method of finishing a workpiece surface using MR fluid comprises the steps of: positioning the workpiece near a carrier surface such that a converging gap is defined between a portion of the workpiece surface and the carrier surface; applying a magnetic field substantially at said gap; introducing a flow of magnetic field-stiffened MR fluid through said converging gap such that a work zone is created in the MR fluid to form a transient finishing tool for engaging and causing material removal at the portion of the workpiece surface; and moving the workpiece or the work zone relative to the other to expose different portions of the workpiece surface to the work zone for predetermined time periods to selectively finish said portions of said workpiece surface to predetermined degrees. The apparatus for finishing a workpiece using MR fluid comprises: a carrier surface adapted to carry the MR fluid; a workpiece holder for holding the workpiece and positioning a portion of the workpiece surface near the carrier surface to define a converging gap therebetween, such that said carrier surface carries MR fluid through said gap; a magnet for applying a magnetic field at said gap to stiffen the MR fluid flowing through said gap for creating a transient finishing tool for engaging and causing material removal at the portion of the workpiece surface; and means for moving the workpiece or the work zone relative to the other to expose different portions of the workpiece surface to the work zone for predetermined time periods to selectively finish said portions of said workpiece surface in predetermined degrees.

DETAILED DESCRIPTION OF THE PREFERRED EMBODIMENTS

Magnetorheological ("MR") fluids, which comprise uniformly dispersed, noncolloidal magnetic material in a carrier fluid, are designed to change Theological properties (such as plasticity, elasticity, and apparent viscosity) or other fluid properties when subjected to a magnetic field. Typical uses of known magnetic fluid compositions have included shock absorbers, clutches and actuating modules.

The present invention is directed to improved methods and devices for magnetorheological finishing of workpiece surfaces. In accordance with the invention, the workpiece surface is positioned above a carrier surface defining a gap therebetween. MR fluid is deposited on the carrier surface, which then carries MR fluid through the gap. A magnetic field is applied at the gap to substantially stiffen the MR fluid flowing through the gap to form a transient work zone or finishing spot for causing material removal at the workpiece surface. The finishing spot is smaller than the workpiece surface, and by moving the workpiece relative to the carrier surface, the workpiece can be moved over the finishing spot. By controlling the dwell time of the spot in different locations, the process may achieve surface smoothing, removal of subsurface damage, or figure correction as desired to within high tolerances. In the process of finishing the workpiece, the MR fluid carries away heat, abrasive particles, and particles of workpiece material while continuously delivering fresh abrasive particles to the work zone.

Figure 1:
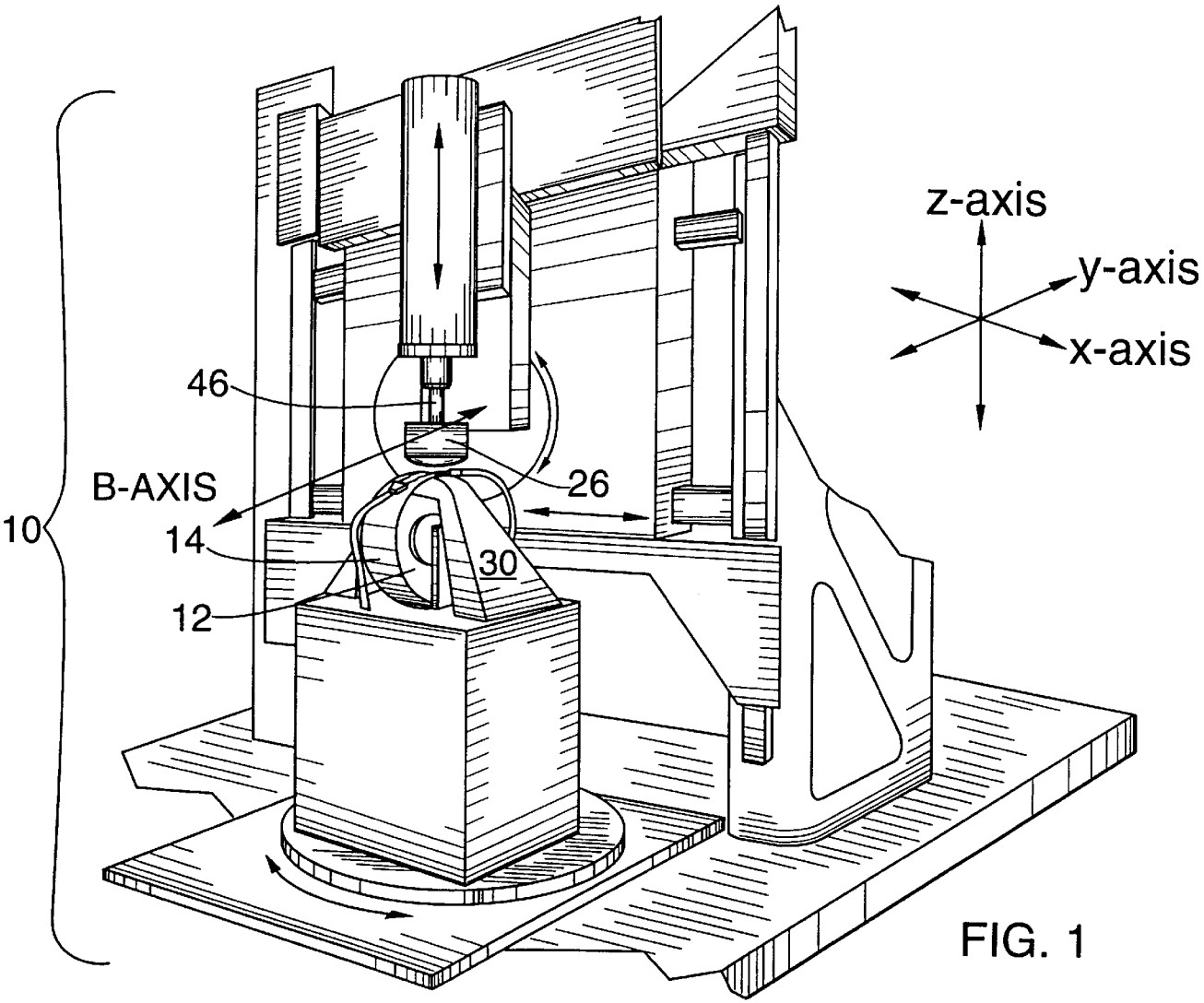
FIG. 1 is a perspective view of an exemplary finishing apparatus in accordance with the present invention.
Figure 2:
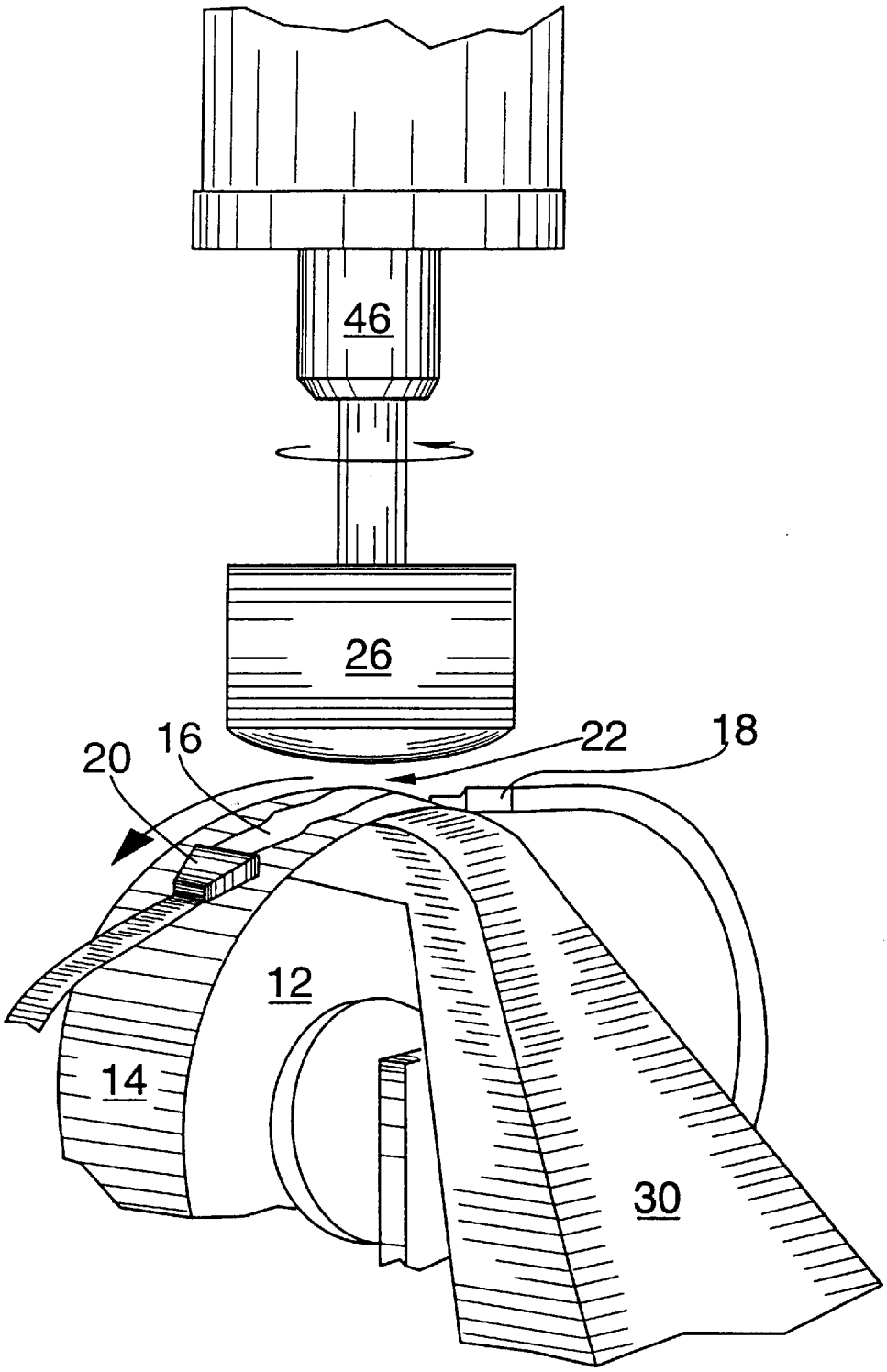
FIG. 2 is an enlarged view of a portion of the apparatus of FIG. 1.
Figure 3A:
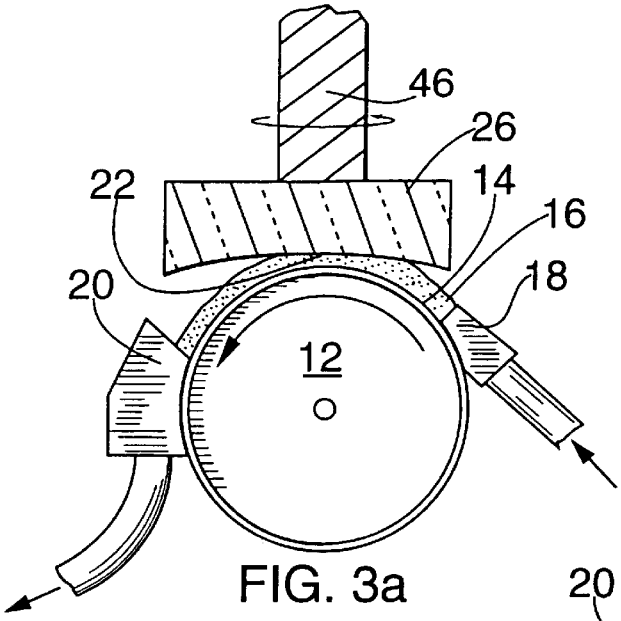
FIGS. 3*a–c* are schematic depictions of the carrier wheel and MR fluid ribbon of the present invention in use to finish concave, flat and convex workpieces.
Figure 3B:
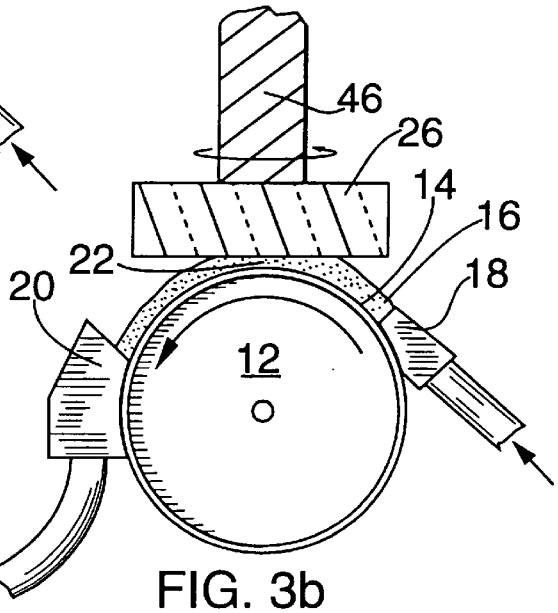
Figure 3C:
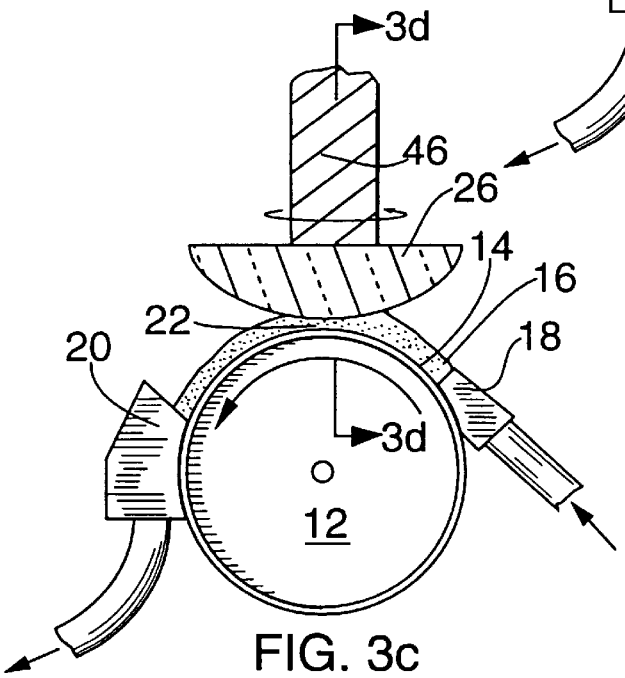
Figure 3D:
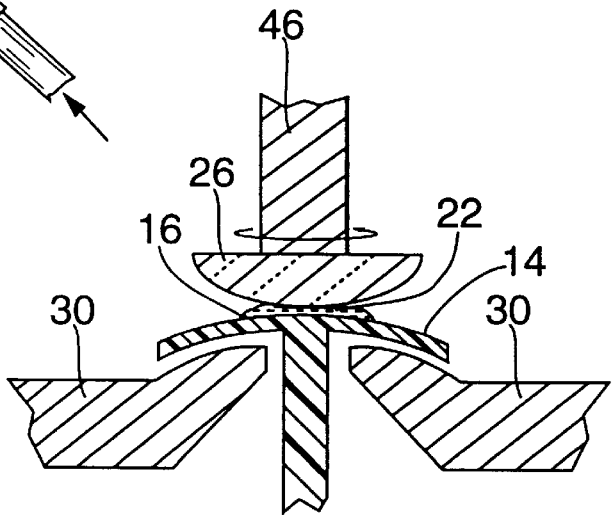
FIG. 3*d* is a cross-section view of the apparatus of FIG. 3*c* taken along line 3*d* of FIG. 3*c* with the addition of the magnetic polepieces.

FIG. 1 illustrates an exemplary MR finishing device 10 in accordance with the present invention. The device 10 includes a vertically-oriented carrier wheel 12 which comprises an outer rim 14 defining a carrier surface (shown in greater detail in FIG. 2). (Although not shown, the carrier surface may also comprise the bottom wall of the inside of a circular trough, the upper surface of a turntable or belt or any other suitable moving surface. Some possible alternate configurations are disclosed FIGS. 19 and 20.) The vertical carrier wheel supports a ribbon-shaped volume of MR fluid 16. The ribbon of MR fluid is deposited on one side of the wheel by a fluid delivery nozzle 18 and is carried by the rotation of the wheel to the far side where it is retrieved by fluid collector 20. The wheel carries the ribbon through gap 22 between the workpiece surface and the carrier surface at which an optimal magnetic field is applied by a magnet. The vertical carrier wheel is preferably made of a non-magnetic material such as aluminum or plastic.

Preferably the rim of the carrier wheel is not flat, so as to form a cylinder, but instead is convexly curved across its width. In a preferred embodiment the wheel is a spheric section, which is to say that the radius of curvature across the width of the rim is equal to the radius of the wheel around its circumference. A carrier wheel that presents a convexly curved surface at the finishing spot has the advantage that it can be used in finishing flat and concave surfaces as well as convex surfaces as shown in FIG. 3. As a result, the carrier wheel of the present invention in its vertical orientation can be used in finishing arbitrary shapes, including, for example, toric shapes and cylinders. However, a wheel dedicated to finishing of flat surfaces only may advantageously have a rim that is flat across its width.

Figure 4A:
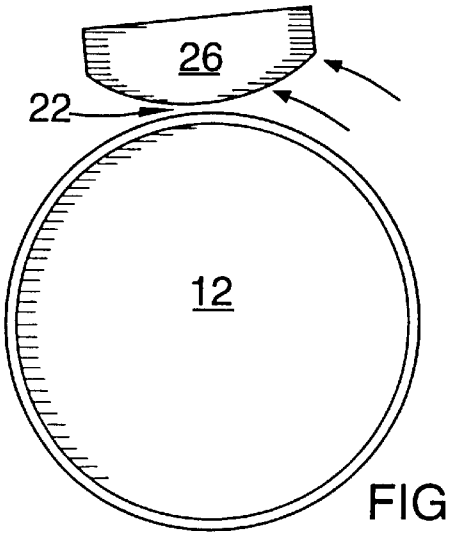
FIGS. 4A and 4B are schematic drawings depicting the angle with which the MR fluid would impinge on the workpiece using circular and flat carrier surfaces, respectively.
Figure 4B:
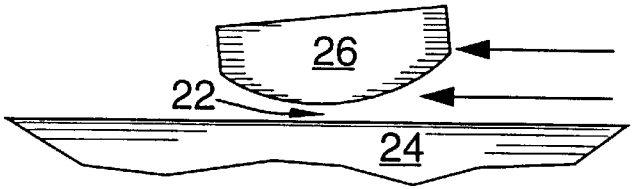

Another advantage of the use of a vertical carrier wheel is that the wheel brings the MR fluid into contact with the workpiece at a steeper angle than a flat carrier surface. As shown in FIG. 4, in contrast to a flat carrier surface 24, which typically brings the MR fluid ribbon into contact with workpiece 26 at an angle that is nearly tangent to the workpiece, carrier wheel 12 causes the MR fluid ribbon to impinge on workpiece 26 at an angle that is more obtuse. As a result, the ribbon is less likely to be obstructed by the outer edge of the workpiece as it travels to the finishing spot. The inventors have found -hat this advantage can be obtained by use of a vertical carrier wheel with no decrease in removal rate.

The magnetic field at the gap may be created by any means, including electromagnets and permanent magnets. In the exemplary device of the present invention the magnetic field is created by a DC electromagnet equipped with polepieces 30 positioned under the carrier surface for applying the magnetic field to the MR fluid. The volume of space that falls directly between the polepieces can be termed a magnet gap. The magnetic field outside the magnet gap can be termed the fringing field. The magnetic field lines in the fringing field are arcs connecting the poles. The magnet gap between the polepieces of the present invention is positioned under the carrier surface. The polepieces of the present invention may be used with vertical wheel 12 of FIG. 1 or with any other suitable configuration of a carrier surface. The MR fluid ribbon is carried through the fringing field by the carrier surface. Where the carrier surface is the rim of a vertical carrier wheel, the polepieces are situated on either side of the wheel under the rim.

The present invention contemplates polepieces that create an optimal fringing field in the gap between the workpiece and the carrier surface where the finishing spot or work zone is created. The polepieces are also preferably designed to minimize field strength at the fluid collector so as to inhibit stiffening of the MR fluid and assist in fluid pick-up. Both of these goals may be met by polepieces that create an enhanced fringing field above the magnet gap, i.e., in the direction of the finishing spot, and a diminished fringing field below the magnet gap.

Figure 5B:
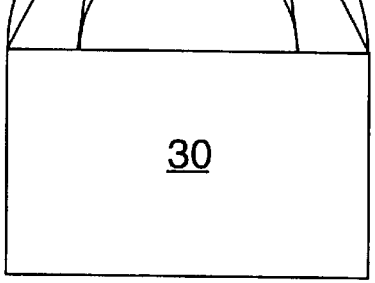
FIG. 5A is a cross-section view of an exemplary magnetic polepiece in accordance with the present invention.
FIG. 5E is a front view of the magnetic polepiece.
FIG. 5C is a top view of the magnetic polepiece.
Figure 5C:
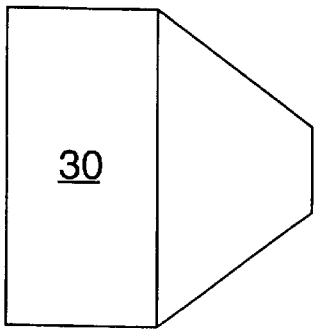
Figure 5A:
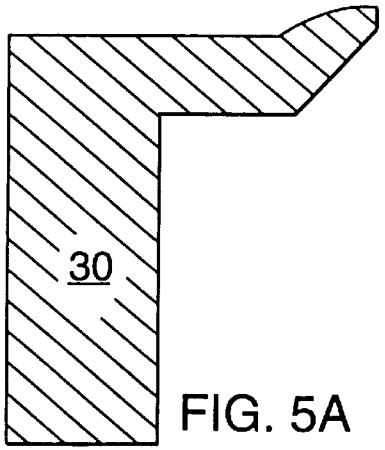
Figure 6A:
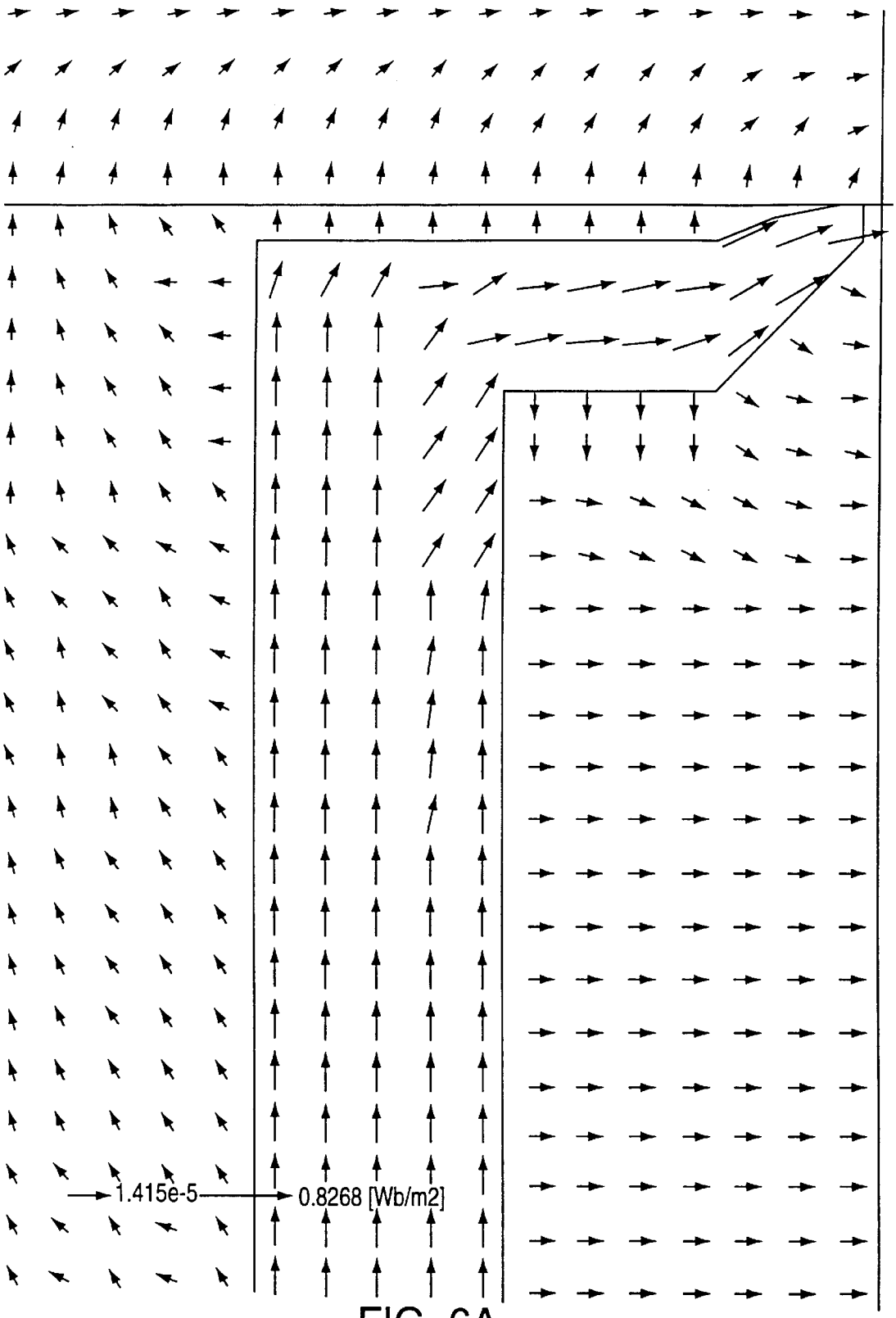
FIGS. 6A and 6B are field plots of magnetic field magnitude and direction in and surrounding an exemplary polepiece according to the present invention.
Figure 6B:
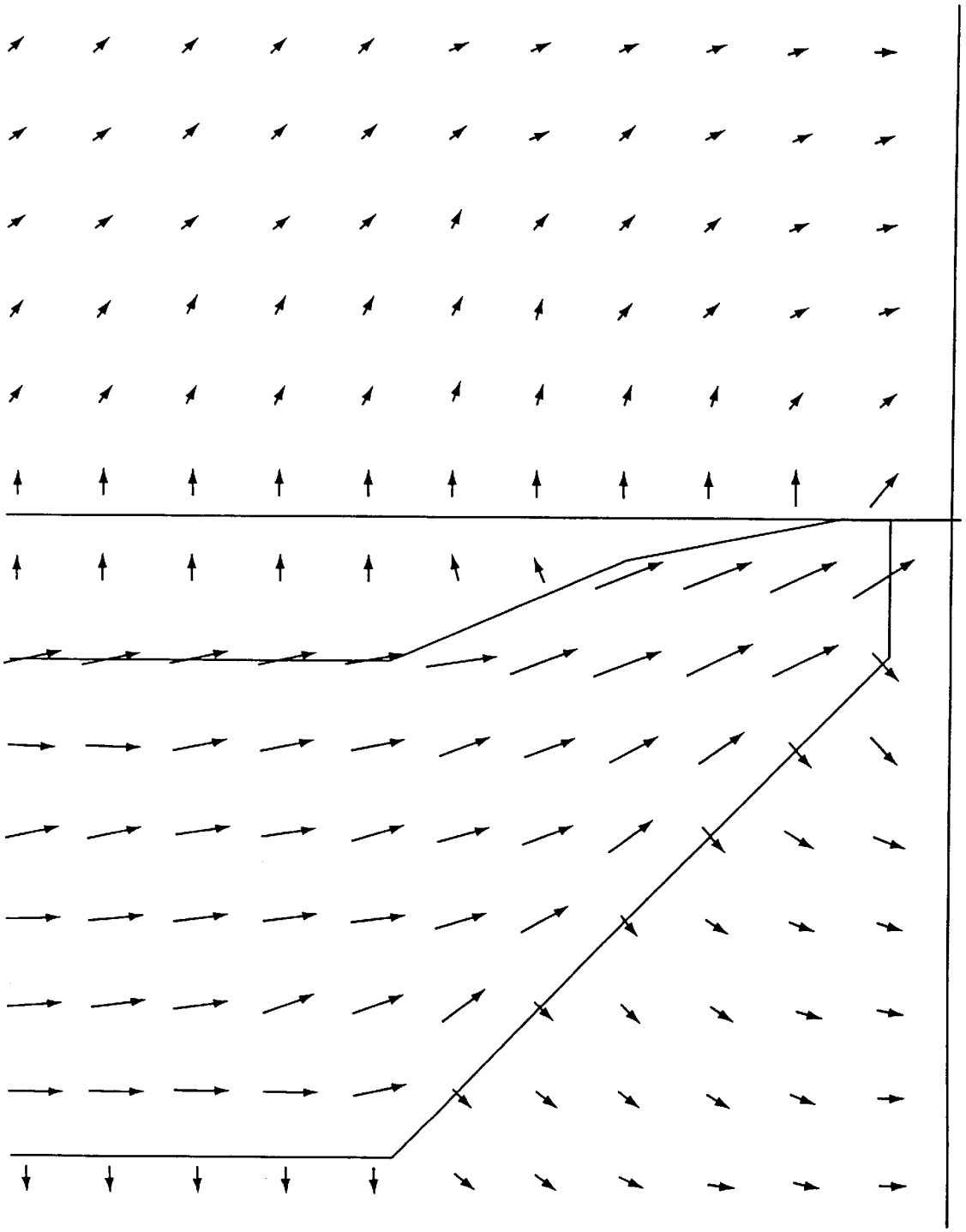

An exemplary polepiece design for use with a vertical carrier wheel that is predicted to have these characteristics is depicted in FIG. 5. FIGS. 6A and 6B are cross-sectional profiles of the exemplary polepiece which include field vectors of magnetic field magnitude and direction in and surrounding the polepiece. This design has the additional advantage that it can be made with conventional machining rather than CNC machining, which should substantially reduce the cost of manufacturing.

Figure 7:
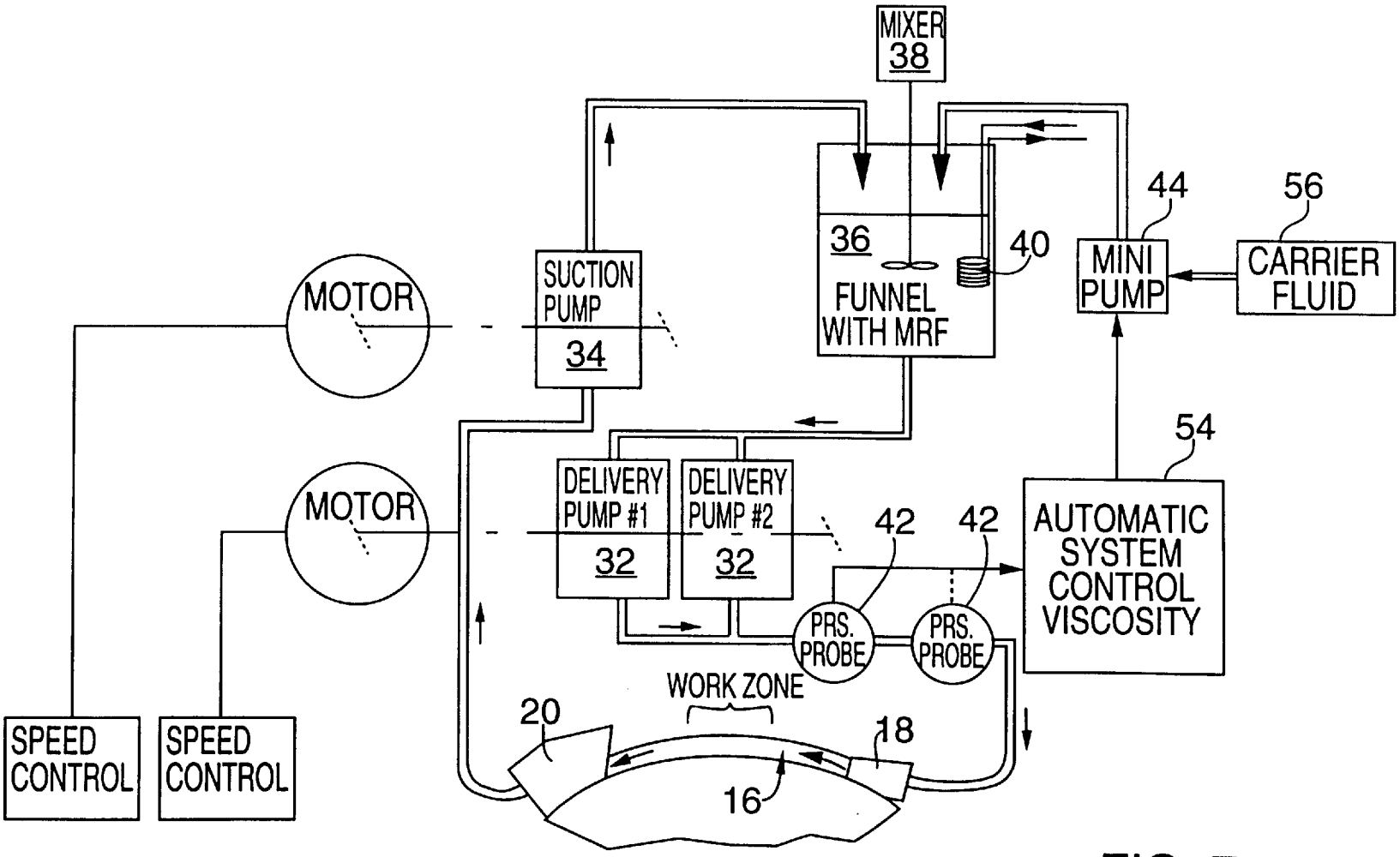
FIG. 7 is a schematic depiction of an exemplary fluid circulation system in accordance with the present invention.

The exemplary apparatus additionally comprises a fluid circulation system. (FIG. 7). The fluid circulation system comprises fluid delivery nozzle 18, fluid collector 20, and apparatus to recycle the fluid from the collector back to the delivery nozzle. The fluid circulation system of the present invention may be used with any carrier surface including the carrier wheel depicted in FIG. 1.

In order to reduce evaporation of carrier fluid and degradation of the MR fluid due to air contact, the fluid circulation system preferably reduces exposure of the MR fluid to the atmosphere, excepting the ribbon of fluid transiently present on the carrier surface. Since the fluid circulation system is external to the finishing apparatus, the MR fluid may be subjected to any number of regulatory functions between the collector and the nozzle, allowing the reproducibility and predictability of the MR fluid ribbon to be greatly enhanced.

Figure 8A:
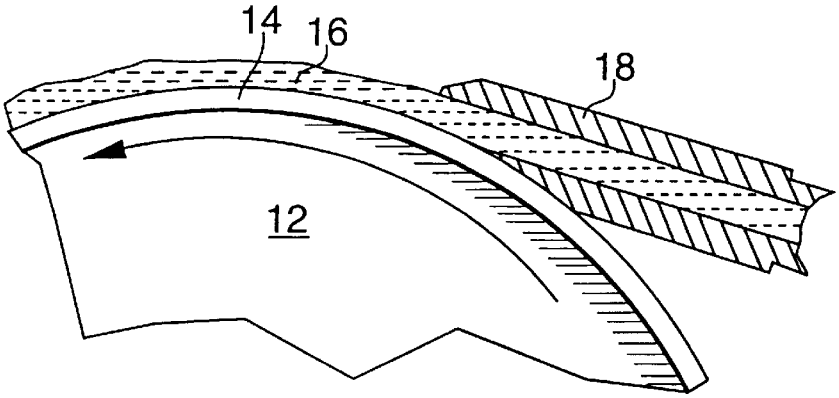
FIG. 8*a* is a side cross section view of an exemplary fluid delivery nozzle of the present invention in contact with a vertical wheel.
Figure 8B:
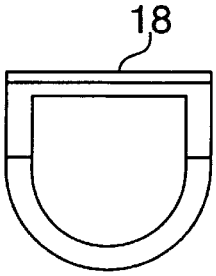
FIG. 8*b* is a frontal view of an examplary fluid delivery nozzle.

An exemplary fluid delivery nozzle 18 for use with vertical carrier wheel 12 is depicted in FIG. 8. The fluid delivery nozzle is preferably composed of magnetically soft material such as iron. The magnetically soft nozzle shields the MR fluid from magnetic fields and thus inhibits the stiffening of fluid before it leaves the nozzle. The nozzle and the tube feeding the nozzle preferably provide laminar flow of the MR fluid. The nozzle may be internally tapered. The nozzle may or may not make direct contact with the carrier discharge end of the surface. If it does, a Teflon® or similar coating may be advantageous to prevent wear on the carrier surface. The trajectory of the fluid as it exits the nozzle is preferably tangential to the carrier surface.

In one embodiment, the MR fluid ribbon is shaped by the fluid delivery nozzle when the MR fluid is deposited on the carrier surface. In an alternate embodiment, the ribbon may be shaped by a scraper brought into contact or near-contact with the carrier surface, wherein the scraper has an opening that shapes the MR fluid deposited on the carrier surface by the nozzle. Since in this embodiment the MR fluid may form a pool behind the scraper, the carrier surface may be equipped with sidewalls (not shown) such as those in a circular trough. The nozzle or scraper is preferably located in a region subjected to some magnetic field strength so that the MR ribbon takes on sufficient plasticity to substantially maintain the shape it receives from the nozzle or scraper.

Figure 9A:
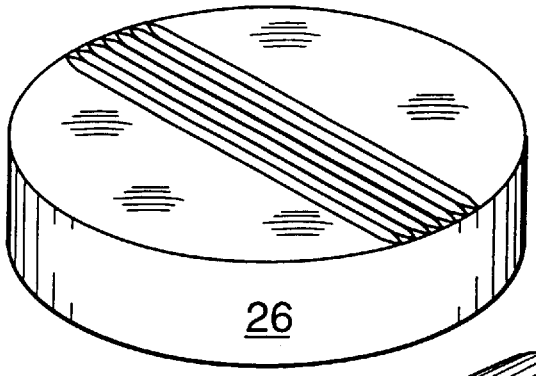
FIG. 9A is a perspective view of a workpiece shaped by use of the scraper of FIG. 9B.

The shape of the nozzle or the scraper is one factor in determining the cross-sectional size and shape of the ribbon. This in turn may influence the size of the finishing spot; a narrower ribbon can create a narrower finishing spot. A narrower spot can provide higher resolution in the finishing process and therefore is especially useful in finishing very small workpieces. FIG. 9D is a perspective view of scraper 48 that was used to create a ribbon with a triangular cross-section and the triangular ribbon it created. This "tapered" ribbon has been used to successfully finish lenses as small as 5 mm in diameter.

Figure 9B:
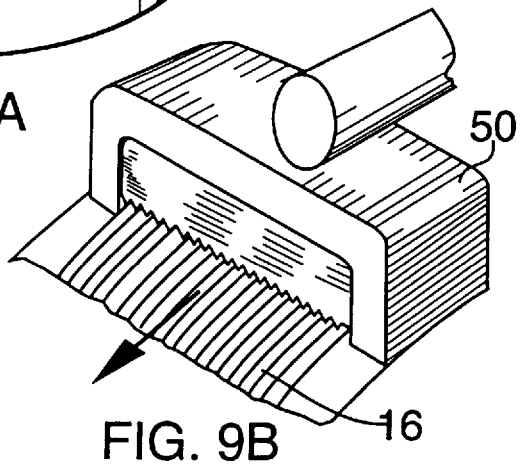
FIG. 9B is a perspective view of a scraper used to create a sawtooth pattern in MR fluid.
Figure 9D:
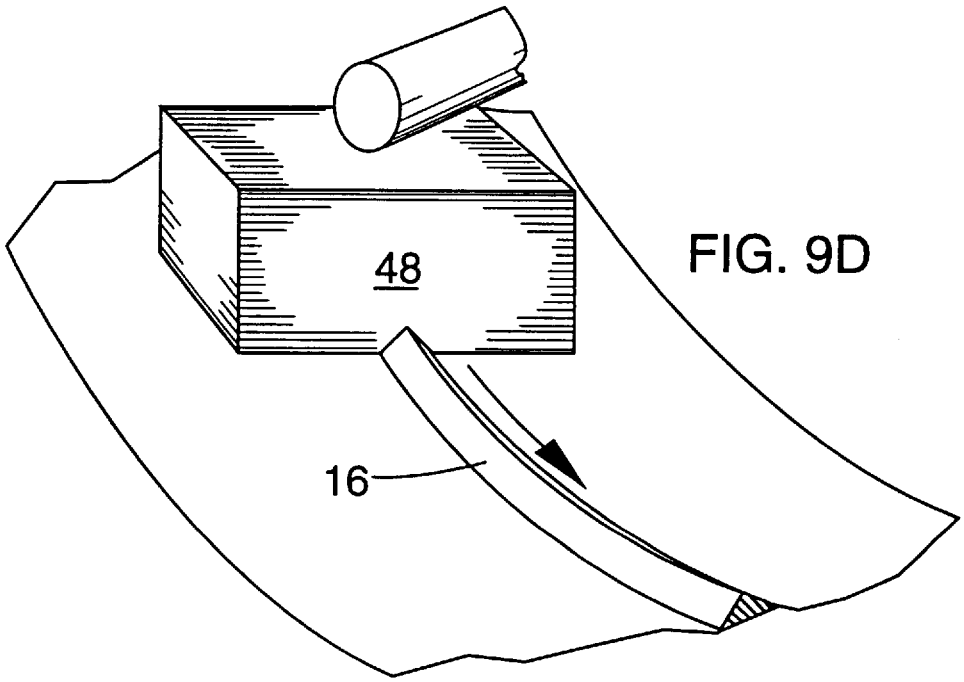
FIG. 9D is a perspective view of a scraper used to create a triangular MR fluid ribbon.
Figure 9C:
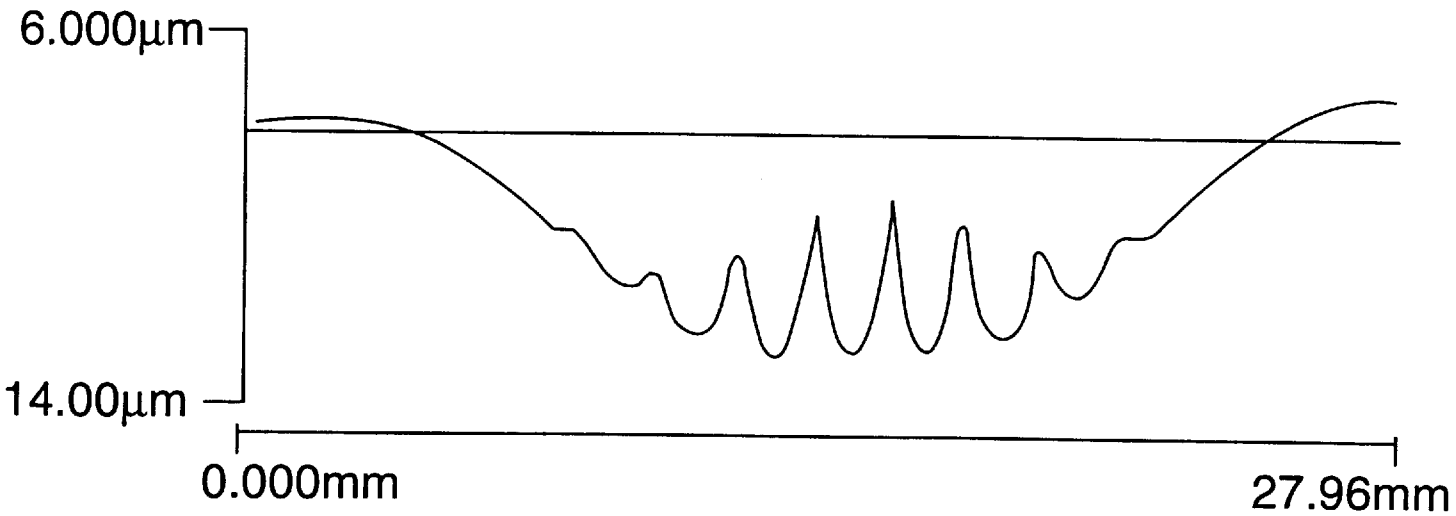
FIG. 9C is a profile of the workpiece of FIG. 9B taken with a Rank Taylor Hobsen Form Talysurf® profiler.

FIG. 9B is a perspective view of scraper 50 that was used to create a sawtooth pattern and the sawtooth-shaped ribbon it created. This scraper was made for the purpose of illustrating the ability to create a ribbon that maintains its shape and transfers that shape to the workpiece. FIG. 9A is a perspective view of an originally flat workpiece made of K7 glass that was shaped by contact for 5 minutes with the ribbon formed by the scraper of FIG. 9B. FIG. 9C is a profile of the workpiece of FIG. 9A taken with a Rank Taylor Hobsen Form Talysurf® profiler.

FIG. 7 is a schematic illustration of the fluid circulation system. As shown, the MR fluid may be pressurized by one or more delivery pumps 32. The fluid circulation system preferably delivers the MR fluid to the carrier surface at a linear rate equal to or greater than the linear speed of the carrier surface. When the MR fluid delivery rate is slower that the carrier surface speed, a discontinuous ribbon may be formed. When the MR fluid delivery rate is faster than the carrier surface speed, a thicker ribbon is created. The thickness of the ribbon may be controlled by means of changing the MR fluid delivery rate. Expressed mathematically, the fluid delivery rate, Q ($cm^3$/sec), is equal to the cross-sectional area of the ribbon, S ($cm^2$), times the linear velocity of the carrier surface, V (cm/sec): $Q=S\times V$. Thus for a given carrier surface velocity, an increase in the fluid delivery rate Q results in an increased ribbon cross-section, S. Likewise, for a given fluid delivery rate Q, a decrease :in the carrier surface velocity V results in an increased ribbon cross-section, S.

Figure 10A:
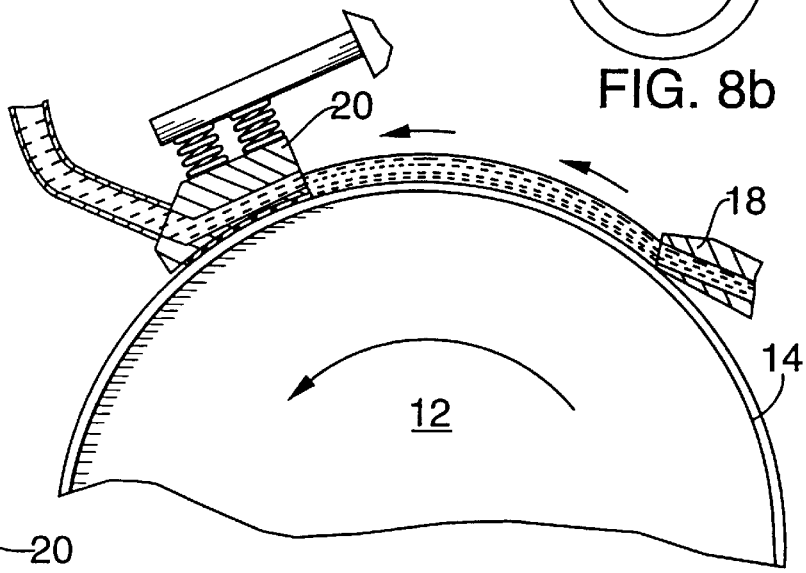
FIG. 10*a* is a side cross-section view of an exemplary fluid collector of the present invention.
Figure 10B:
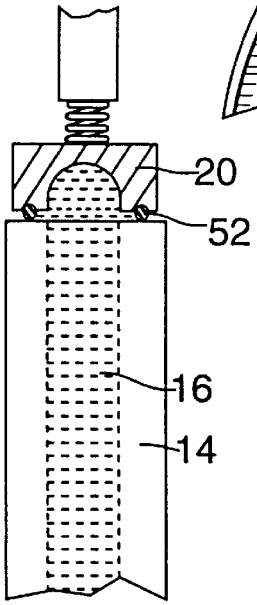
FIG. 10*b* is a frontal cross-sectional view of the collector.
Figure 10C:
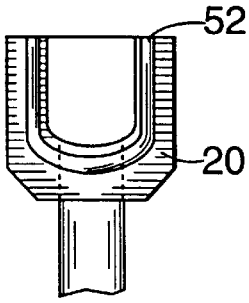
FIG. 10*c* is a bottom view of the collector.

Fluid collector 20 (FIG. 10) may include a pickup scraper 52 of rubber, flexible plastic or like material that acts as a squeegee to separate the fluid from the carrier surface. The wheel engaging portion of the pickup scraper should conform to the shape of the carrier surface. The wheel engaging portion preferably forms a cup-like shape, or U-shape, with the MR fluid ribbon entering at the open side. Fluid collector 20 is preferably connected to one or more suction pumps 34 so as to draw in the MR fluid. The fluid collector advantageously comprises or is covered by a magnetic shield of magnetically soft material such as iron. This magnetic shield substantially releases the MR fluid from the effects of surrounding magnetic field so as to allow the fluid to return to a less viscous state. In addition, the collector is advantageously located in a position that is farther from the magnetic polepieces than the nozzle so as to reduce the intensity of its exposure to the magnetic field.

The circulation system advantageously uses peristaltic pumps so that contact between the MR fluid, which may contain abrasive particles, with degradable parts, which are difficult to replace, is reduced. In a peristaltic pump, the only part subject to any substantial wear by the MR fluid is a short piece of plastic tubing that lasts through several hundred hours of use and can be replaced cheaply. Peristaltic pumps themselves are relatively inexpensive. It has been found that they can be operated at low flow rates without generating gaps in the ribbon. Two or more pumps may be used in parallel to stagger the pulsations that may be created and thereby decrease their amplitude. In a preferred embodiment, two three-headed delivery pumps 32 are used wherein the drive heads are offset by 60° with respect to each other.

MASTERFLEX® 6485-82 PharMed® tubing can be used for the suction section of the fluid circulation system. IMPERIAL-EASTMAN ⅜ tubing can be used for the delivery portion of the fluid circulation system. EASY LOAD MASTERFLEX® pumps, mod. no. 7529-00 can be used as delivery pumps. COLE-PALMER MASTERFLEX® pump, mod. no. 7019-25 can be used as suction pumps. Permanent magnet motor mod. no. 2M168C, Dayton, can be used to drive the pumps, with DC Speed Controls mod. no. 5X485C, Dayton.

Figure 11A:
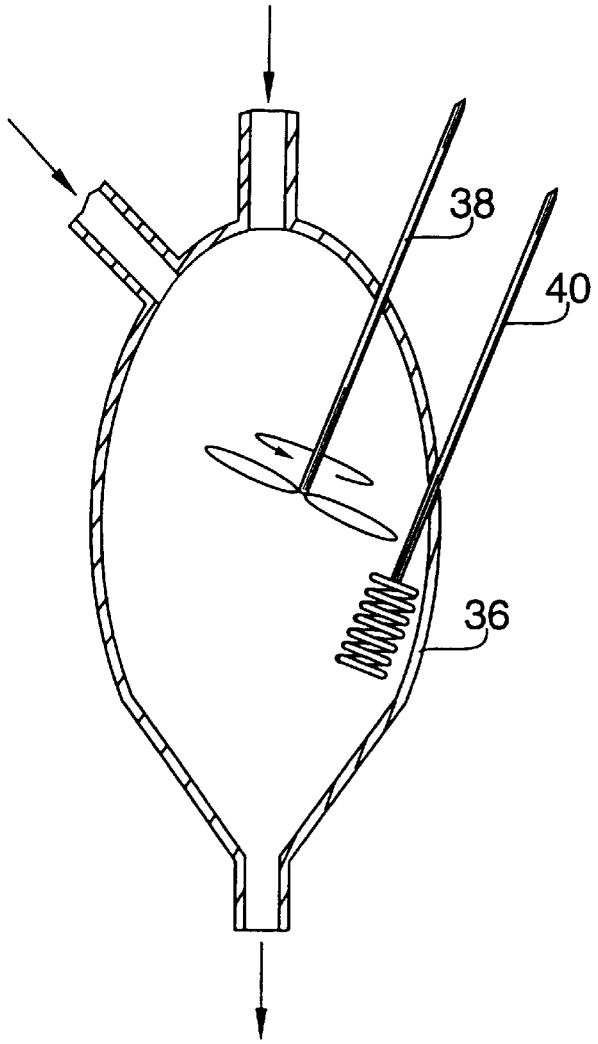
FIG. 11*a* is a schematic depiction of a reservoir of the present invention.
Figure 11B:
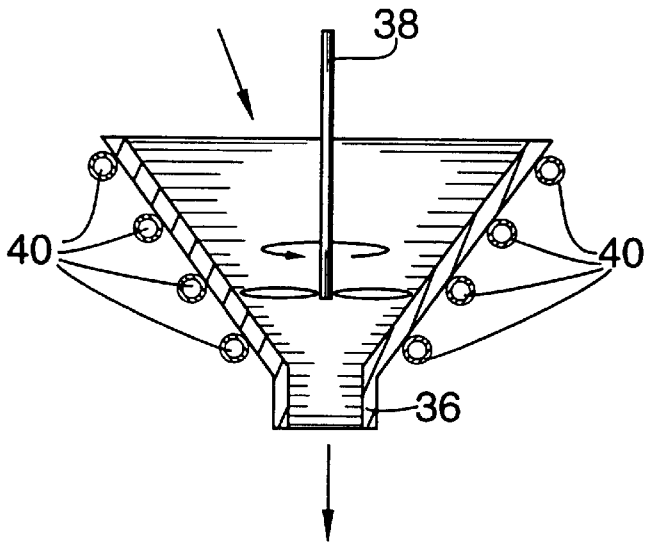
FIG. 11*b* is a schematic depiction of an alternate reservoir for use with the present invention.

The MR fluid removed from the carrier wheel by the collector may be routed to reservoir 36 as shown in FIG. 11A. A PP NALIGENE®, 1000 ml Seperatory Funnel can be used as a reservoir. Preferably the MR fluid is delivered to such a reservoir with sufficient force to homogenize the MR fluid by breaking up any remaining magnetic particle structures created by the applied magnetic fields. However, the reservoir may also contain additional agitating equipment for this purpose such as a stirrer 38. A Laboratory stirrer TLINE, mod. no. 102 can be used for this purpose. Alternately, other mixing or homogenizing equipment could be used. The reservoir may be nonmagnetic, wear-resistant material like stainless steel. It may have a conical or some other shape that provides no settling zones where MR fluid could aggregate. Also, it may be configured to allow an agitator that reaches a large volume of the reservoir to fit therein so as to leave no settling zones. (FIG. 11B)

The fluid circulation system may additionally comprise temperature regulating apparatus such as cooling mechanisms to remove the heat generated in the finishing zone and carried away by the MR fluid. The temperature of the MR fluid may also be increased by heat generated by the operation of the MR fluid circulation pumps or the electromagnet. Unregulated high temperatures may lower MR fluid viscosity and may result in high rates of carrier fluid evaporation. Unregulated high temperatures may also cause thermal expansion of parts of the device, leading to inaccurate positioning of the workpiece in the MR fluid and a resultant loss of figure control. In an exemplary apparatus, the MR fluid is cooled by immersion of a cooling coil 40 in the reservoir. Constant temperature chilled water is supplied to the cooling coil by connecting it to a closed loop water chiller such as a Brinkman Lauda RM6. The temperature of the MR fluid is typically kept at about 21–22 degrees C. The fluid circulation system may additionally comprise composition regulating apparatus such as an automatic viscosity control system to restore carrier fluid lost to evaporation or other causes from the MR fluid. An automatic viscosity control system 54 may be used to maintain the MR fluid at a constant viscosity by automatically dripping carrier fluid into the reservoir to replace losses. The viscosity control system may comprise a viscosity monitoring apparatus functionally connected to a carrier fluid pump 44 with a reservoir of carrier fluid 56. In an exemplary apparatus shown in FIG. 7, viscosity is monitored by use of one or more pressure probes 42 located in the delivery line, since pressure changes in the delivery line between the delivery pump(s) and the delivery nozzle are proportional to viscosity changes for a constant flow rate. Preferable pressure probes are diaphragm sensors such as Cooper PFD 102, since they minimize stagnation points in the line which would allow the MR fluid to settle and clog the sensors. The pressure probe signal (or, when multiple probes are used, the difference in the signals from successive pressure probes) is proportional to the viscosity of the MR fluid if the flow rate of the fluid is constant. The pressure probe signal (or differential signal) is compared to a reference value and if the signal exceeds the reference, an error signal is sent to an electrical relay or motor driver, which activates the carrier fluid mini-pump 44 until the signal returns below the maximum level. In some embodiments the constant of proportionality between the pressure probe signal (or differential signal) and the error signal must be chosen to avoid over-correction (resulting in oscillation), or under-correction (resulting in sluggish control of viscosity).

Alternatively, the MR fluid magnetic particle concentration may be monitored by use of an inductance probe, such as a coil of wire wrapped around a tube carrying the flowing MR fluid. A higher inductance reading from the coil indicates a higher magnetic particle concentration and a higher MR fluid viscosity. However, this technique fails to sense significant viscosity changes brought about by changes in temperature or nonmagnetic particle concentration. It should be considered only as a secondary indicator of MR fluid stability. Pressure measurements have proven to be more sensitive than inductance measurements.

Selection of a stable MR fluid greatly enhances reproducible and predictable finishing. Many MR fluid compositions are known in the art, including both oil-based and water-based fluids. The present application contemplates use of an MR fluid that is preferably based on an aqueous carrier fluid for most applications.

However, an aqueous carrier fluid might not be suitable for use on some workpieces such as water soluble workpieces like those comprising KDP ($KH_2PO_4$) crystals.

The MR fluid contains non-colloidal magnetic particles such as carbonyl iron particles. Table 1 identifies four carbonyl iron powders available from GAF Corp. that have been found to be useful in MR fluids.

TABLE 1

| Type | Description | Median Diam. | Largest particle |
|---|---|---|---|
| S-1100 | largest size available | 5.170 μm | 22.79 μm |
| S-1701 | silica coated particles | 4.667 μm | 15.17 μm |
| N-1370 | 5% nitrided particles | 3.845 μm | 15.17 μm |
| S-3700 | smallest size available | 3.089 μm | 13.24 μm |

To enhance material removal, the MR fluid may also contain a nonmagnetic abrasive material, such as cerium oxide ($CeO_2$) particles. The choice of nonmagnetic abrasive material is dictated by the physical properties (e.g. hardness) and chemical properties (e.g. chemical durability) of the workpiece to be finished. Table 2 lists MR fluid formulae using a variety of abrasive particles and the removal rates obtained with those formulae when the MR fluid was used to finish a fused silica workpiece using the method of the present invention on an apparatus employing a rotating trough carrier surface. Removal rates were measured by comparison of before and after profiles of the workpiece taken with a Zygo Mark IV xp® interferometer. The first two formulae comprise no added abrasives; they rely on the abrasive qualities of the carbonyl iron alone. Table 3 lists removal rates for a variety of workpiece materials obtained using a standard MR fluid formula containing a cerium oxide abrasive (Formula D of Table 2) and an enhanced formula containing cerium oxide and nanodiamond abrasives (Formula E of Table 2) using the method of the present invention on an apparatus employing a rotating trough carrier surface. The data demonstrate that the present method is useful for finishing even very hard materials such as sapphire ($Al_2O_3$).

TABLE 2

| | Abrasive type | Abrasive size, μm | Vol % abrasive | Vol % CI | Vol % $H_2O$ | Vol % Glycerine | Vol % $Na_2CO_3$ | peak removal rate μm/min | Vol. removal rate $mm^3$/min |
|---|---|---|---|---|---|---|---|---|---|
| A | none, just CI, S-3700, 3 μm | — | 0.00 | 44.36 | 53.27 | 2.05 | 0.31 | 1.28 | 0.176 |
| B | none, just CI, S-1701, 4.5 μm | — | 0.00 | 46.04 | 51.53 | 2.12 | 0.67 | 1.836 | 0.1556 |
| C | small $CeO_2$ CeRox1663 | 1 | 4.84 | 35.16 | 57.23 | 2.38 | 0.39 | 2.064 | 0.2808 |
| D | Std. $CeO_2$ CeRite 4250 | 3.5 | 5.7 | 36.05 | 55.11 | 2.41 | 0.74 | 2.104 | 0.22 |

TABLE 2-continued

| | Abrasive type | Abrasive size, μm | Vol % abrasive | Vol % CI | Vol % $H_2O$ | Vol % Glycerine | Vol % $Na_2CO_3$ | peak removal rate μm/min | Vol. removal rate $mm^3$/min |
|---|---|---|---|---|---|---|---|---|---|
| E | Std. $CeO_2$ CeRite 4250 w/15 g nanodiamond | — | — | — | — | — | — | 2.4 | .36 |
| F | mixture: $CeO_2$ and $Al_2O_3$ | 3.5/1.0 | 4.2/4.2 | 36.09 | 53.18 | 2.33 | 0.00 | 1.992 | 0.2464 |
| G | $Al_2O_3$ #1 | 2.1 | 8.67 | 35.8 | 53.16 | 2.26 | 0.12 | 1.4 | 0.1604 |
| H | Al2O3 #9 | 7.0 | 8.77 | 36.25 | 52.6 | 2.28 | 0.1 | 1.632 | 0.1552 |
| I | SiC | 4 | 6.72 | 36.08 | 54.91 | 2.2 | 0.09 | 1.124 | 0.1257 |
| J | $B_4C$ | 7 | 5.94 | 36.19 | 55.22 | 2.28 | 0.37 | 0.574 | 0.0667 |

TABLE 3

| Workpiece Material | Hardness $H_k$ | Standard peak removal rate μm/min | Enhanced peak removal rate μm/min | Standard vol. removal rate $mm^3$/min | Enhanced vol. removal rate $mm^3$/min |
|---|---|---|---|---|---|
| $Al_2O_3$ | 2000 | 0.313 | .524 | .00189 | .0294 |
| Silicon | 1100 | 1.46 | 4.03 | .23 | .6 |
| TaFD5 | 683 | 1.872 | 1.776 | 0.0205 | 0.23 |
| fused silica | 669 | 2.076 | 2.4 | .29 | .36 |
| LaK10 | 650 | 2.42 | 2.256 | .45 | .504 |
| SK7 | 559 | | 6.936 | | 1.108 |
| BK7 | 527 | 4.03 | 4.62 | .48 | .7 |
| K7 | 516 | 4.87 | 3.792 | .53 | .636 |
| KzF6 | 434 | | 8.592 | | .88 |
| SF7 | 405 | | 5.556 | | .726 |
| SF56 | 366 | 9.24 | 6.024 | 1.24 | 1.058 |
| LHG8 | 338 | 9.156 | 23.98 | 1.43 | 3.84 |
| ZnSe | 120 | 2.445 | 6.42 | .1935 | .276 |

Figure 12:
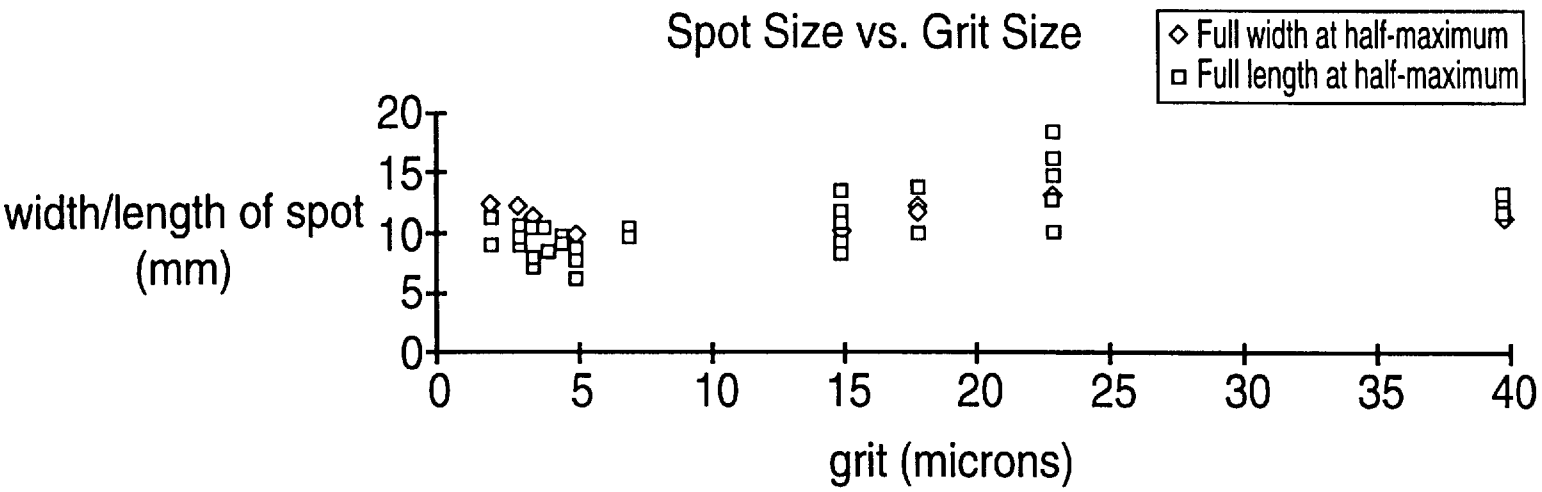
FIG. 12 is a graph illustrating finishing spot widths and lengths achieved with varying sizes of abrasive grit.

It is an advantage of the present invention that the finishing spot is relatively insensitive to abrasive particle size. FIG. 12 is a graph of finishing spot widths and lengths achieved with varying sizes of abrasive grit. The finishing spots were measured with a Zygo Mark IV xp® interferometer. Spot size remained relatively constant with particles of 2–40 microns. A further advantage of the present invention is that unwanted, oversized abrasive particles are less troublesome because they cannot become embedded and scratch the workpiece surface as they can with a solid lap.

The MR fluid may also contain a stabilizer such as glycerol. The stabilizer is used to add viscosity to the MR fluid and to create conditions that help to keep the magnetic particles and abrasive particles in suspension. However, use of an excessive amount of a stabilizer like glycerol can be detrimental in finishing certain materials such as silicate glasses. It is thought that this result is due to the effect of glycerol in inhibiting the ability of water to hydrate and thereby soften the glass surface.

Any form of degradation of the MR fluid can present difficulties in MR finishing since an unstable MR fluid produces a less predictable finishing spot. Rust may cause stability problems with the present type of MR fluid, since the fluid employs finely divided iron particles in an aqueous slurry. Since iron oxide has different magnetic properties than carbonyl iron, the magnetic properties of an MR fluid that is rusting are continually changing and thus rust is a source of unpredictability. In addition, rust in the MR fluid can stain the workpiece.

Since the MR fluid is partially exposed to the atmosphere, it can absorb carbon dioxide, which lowers the pH of the fluid and contributes to the oxidization of the metal. Using deionized water as a carrier fluid slows corrosion but does not entirely solve the problem and it adds to inconvenience and expense.

Figure 13:
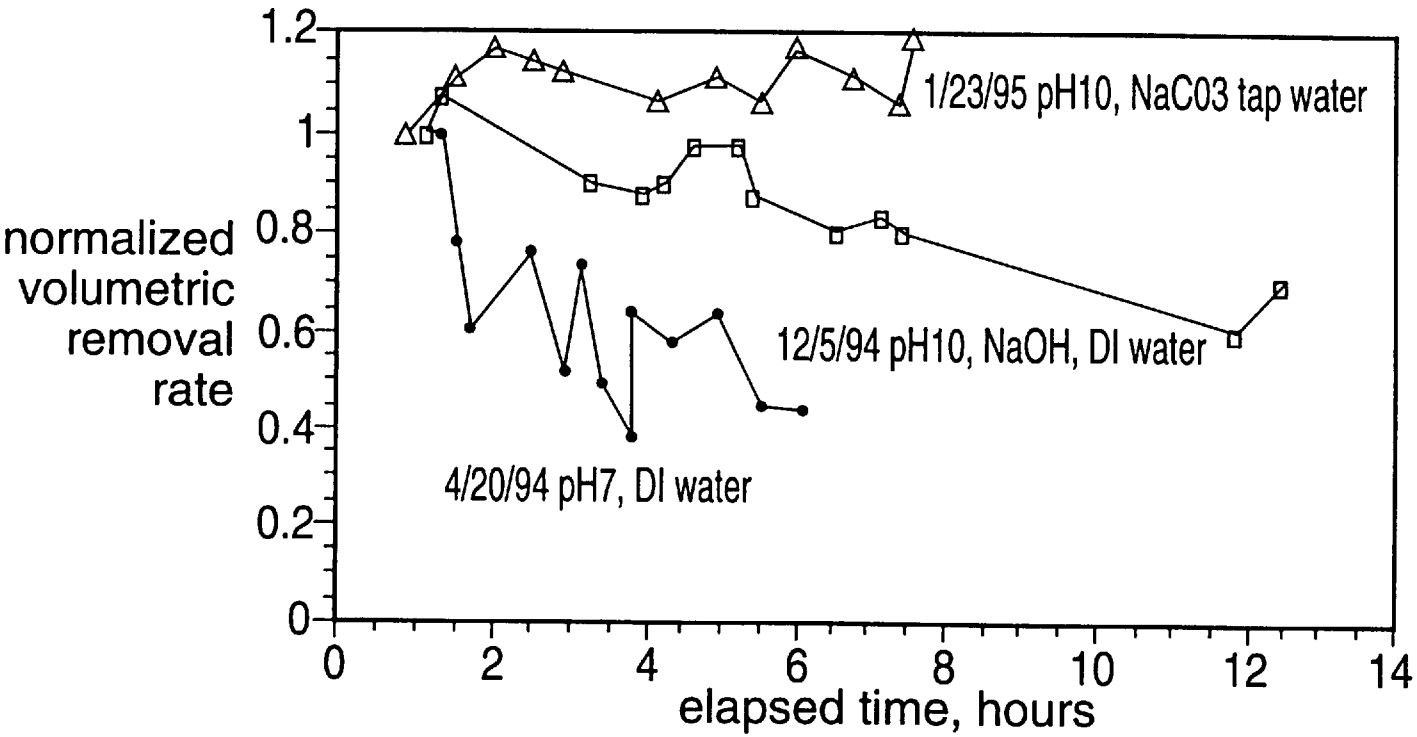
FIG. 13 is a graph indicating volumetric removal rates, normalized to a starting rate of one unit, measured over periods of six or more hours for three MR fluids made with different carrier fluids.

The inventors have found that the addition of alkali sufficient to raise the pH to about 10 both improves stability and simultaneously increases removal rates. Particularly useful alkalis in this application are buffers such as $Na_2CO_3$. A further advantage to the use of an alkaline buffer is that the use of deionized water is no longer necessary and tap water may be used instead. FIG. 13 is a graph indicating volumetric removal rates, normalized to a starting rate of one unit, measured over periods of six or more hours for MR fluids made with three different carrier fluids: deionized (DI) water at pH7, DI water at pH10 with NaOH, and tap water at pH10 with $Na_2CO_3$. (Note that the DI water is assumed to be at pH7 by theory—since it contains no ions, its pH cannot be measured by the use of conventional probes.) The finishing runs were made using the method of the present invention on an apparatus employing a rotating trough carrier surface using identical formulae other than the differing carrier fluid and using identical workpieces and the removal rates were measured as described above. The removal rate for the pH 10 fluid containing $Na_2CO_3$ remained high, while the removal rate for the pH 10 fluid containing NaOH fell off to 80% of the initial rate after 7 hours use, and the removal rate for the pH 7 fluid fell off to about 60% of its initial value after two hours and became erratic. Table 4 demonstrates an increase of about 39% in volumetric removal rate (volume of material removed per second) and an increase of about 50% in peak removal rate (depth of material removed per second) which occurs with the use of a pH 10 carrier fluid (Runs 1 and 2) in comparison to a pH7 carrier fluid (Runs 3 and 4). The finishing runs in table 4 were made using the indicated formulae and using the method of the present invention on an apparatus employing a rotating trough carrier surface with identical workpieces and the removal rates were measured as described above.

TABLE 4

| S1710 | Run 1 | Run 2 | Run 3 | Run 4 |
|---|---|---|---|---|
| Formula | 4.4% glycerin | 4.0% glycerin | 4.0% glycerin | 4.0% glycerin |
| (All use S1710 | 24.3% CeO2 | 21.7% CeO2 | 22.2% CeO2 | 22.2% CeO2 |
| carbonyl iron | 32.4% CI | 28.9% CI | 29.5% CI | 29.5% CI |
| (CI) and | 20 rpm | 20 rpm | 20 rpm | 20 rpm |
| deionized water) | pH 10–11 | pH 9–10 | pH 7 | pH 7 |
| Peak removal rate | 2.4 | 2.8 | 1.6 | 1.84 |
| μm/min | 2.4 | 2.8 | | 1.75 |
| | | 2.6 | | |
| | | 2.6 | | |
| avg. peak removal rate | 2.4 | 2.7 | 1.6 | 1.8 |
| Vol. removal rate | 0.15 | 0.18 | 0.11 | 0.124 |
| mm3/min | 0.17 | 0.15 | | 0.124 |
| | | 0.15 | | |
| | | 0.16 | | |
| avg. vol. removal rate | 0.16 | 0.16 | 0.11 | 0.12 |

Those skilled in the art will understand that, as in table 2, the volume percentages in table 4 are volume percentages.

The present invention contemplates a MR fluid that comprises an aqueous carrier fluid that includes an alkaline buffer such as $Na_2CO_3$ that demonstrates improved stability and resistance to rust, increased removal rates, and which can be formulated with tap water. One useful composition is a fluid containing about 36.05 volume percent carbonyl iron, about 5.7 volume percent $CeO_2$ abrasive, about 55.11 volume percent water, about 2.41 volume percent glycerol, and about 0.74 volume percent $Na_2CO_3$.

Figure 14B:
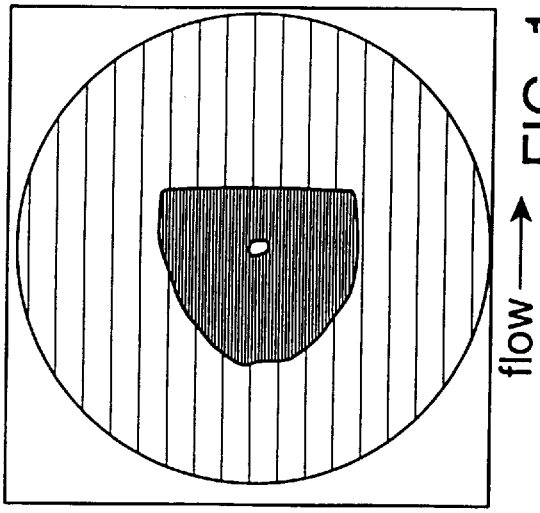
FIGS. 14B and 14C are representations of the MRF removal function "spot" on BK7 glass after 5 seconds of finishing.
Figure 14A:
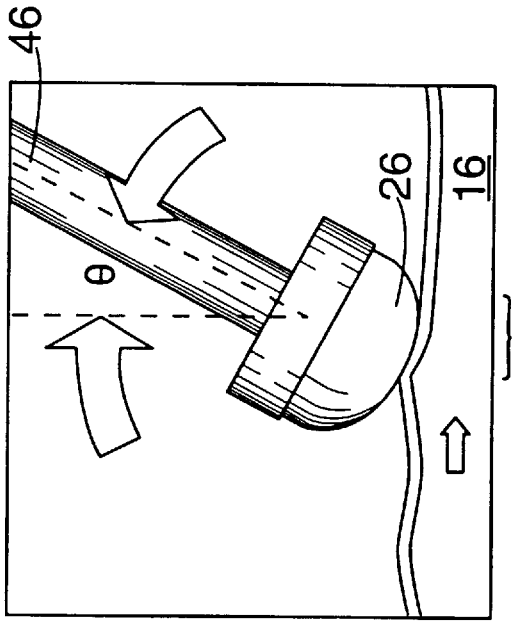
FIG. 14A is a schematic depiction of the apparatus used to obtain the MRF removal function "spot" depicted in FIGS. 14B and 14C.
Figure 14C:
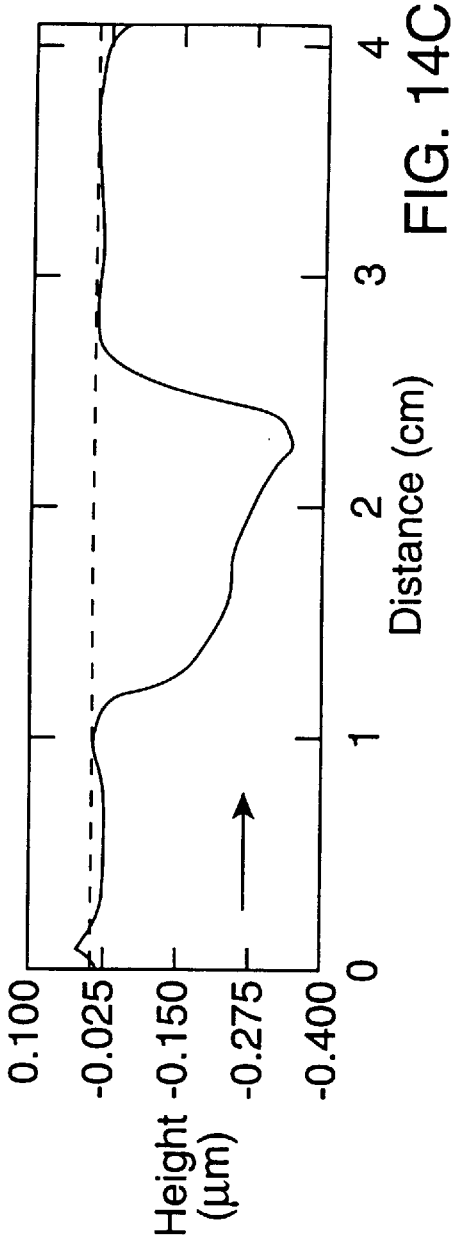
Figures 15A, 15B, 15C:
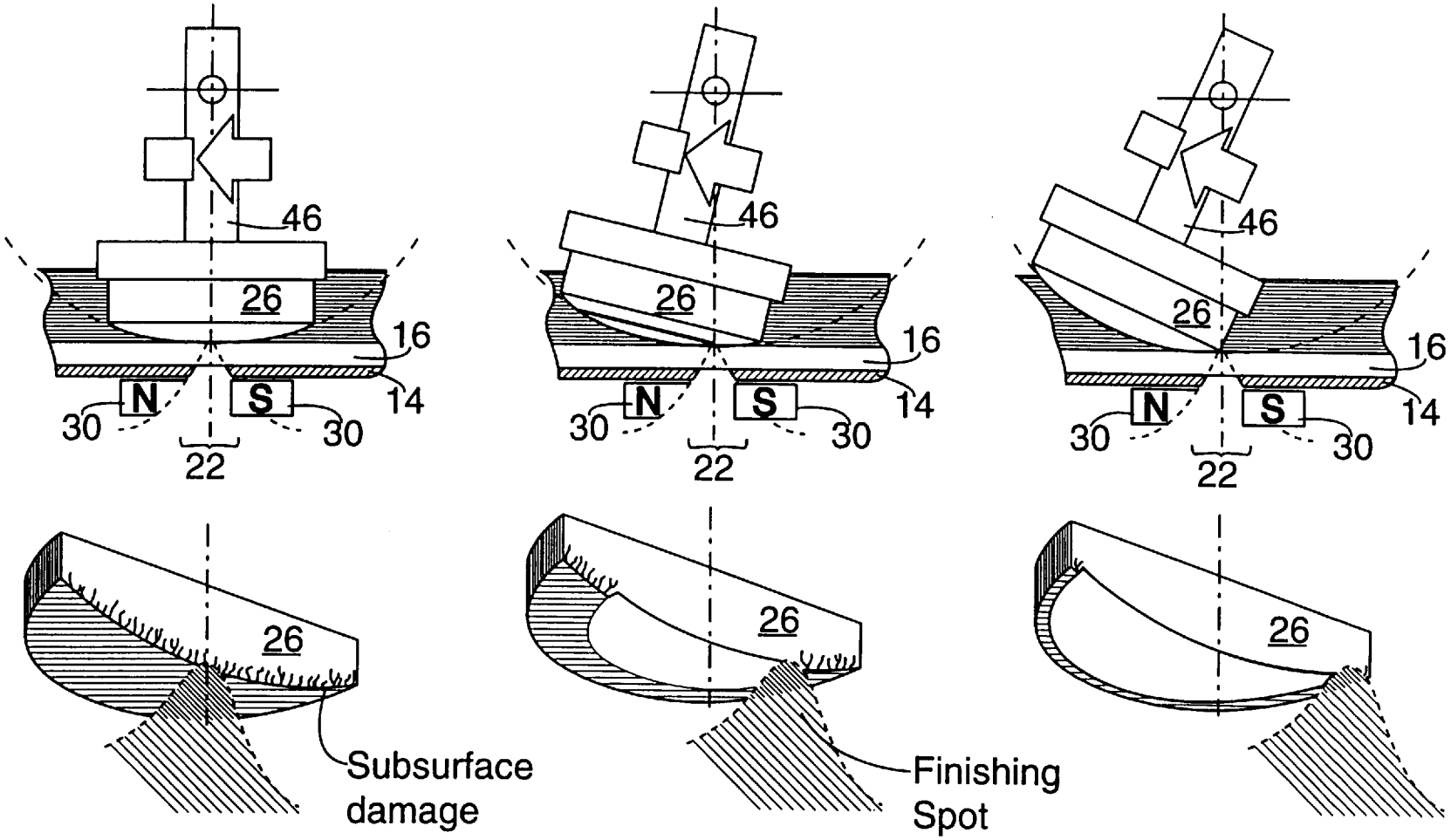
FIGS. 15A–15C are representations of the effect of the finishing spot on a spinning workpiece.

Workpiece 26 to be finished may be mounted on a workpiece holder comprising a rotatable workpiece spindle 46, which is preferably made from a non-magnetic material. The spindle is lowered and the workpiece is brought into contact with the MR fluid ribbon so as to create a finishing soot (FIG. 14). As angle θ is varied, the spot can be swept from the center to the edge of the lens. (FIG. 15). For rotationally symmetric workpieces, the spindle rotates the workpiece about the spindle axis. Since the workpiece is spinning and sweeping, the finishing spot removes material in annular rings from center to edge on the workpiece surface and the resulting lens or other workpiece is symmetrical about the spindle axis. The dwell time at each location on the lens is controlled so that shape errors in the workpiece are corrected. Preferably the determination of dwell times and the control of the spindle motion is done by computer.

Angle θ is measured relative to the vertical. The spindle is pivoted through angle θ around a pivot point. The spindle can be pivoted through angle θ in any direction, but preferably it is pivoted in a direction parallel to or perpendicular to the direction of motion of the MR fluid. In the apparatus of FIG. 1, carrier wheel 12 can be rotated about the Z axis to allow the operator to change the direction in which angle θ pivots relative to the direction of motion of the MR fluid.

Normally, the spindle rotation rate would be held constant. A typical rate is 75 rpm. However, to finish non-rotationally symmetric workpieces or to correct non-rotationally symmetric flaws, the spindle velocity may be varied as a function of the spindle's rotational position. For workpieces such as cylinders, the spindle motion may consist of translational and pivotal motions without any spindle rotation. For flat workpieces, the spindle motion may consist of a combination of translational motion and spindle rotation without any pivotal motion or may consist of translational motions in a raster pattern.

In one system for moving the finishing spot over the surface of the workpiece, angle θ is the only variable. In this system the spindle is lowered until the workpiece is brought into contact with the MR fluid ribbon. The spindle is then rotated through angle θ about a mechanical pivot point, the B-axis, comprising the rotating joint which holds the spindle above the carrier surface. The B-axis is parallel to the Y-axis as shown in FIG. 1. In this system a constant working gap (i.e., the gap between the workpiece and the carrier surface) is maintained if the workpiece is spherical but not when the workpiece is aspheric. However, it is an advantage of the present invention that the finishing spot is tolerant of large variations in gap height. For this reason, aspheric workpieces may be finished even when the spindle is restricted to spheric motion, as demonstrated by Example 2, discussed below.

Another system for polishing rotationally symmetric workpieces is shown in FIG. 1. In this embodiment, spindle motion is reduced to three active degrees of freedom, other than the motion of the spindle's rotation of the workpiece. The motion of the spindle axis is restricted to the XZ plane. The spindle may be moved translationally up and down along the Z-axis, translationally left and right along the X-axis, and rotationally through angle θ clockwise or counter-clockwise around the B-axis.

The machine also has two passive degrees of freedom. The carrier wheel and its support base may be rotated manually about the Z-axis so that the wheel is either parallel or perpendicular to the X-axis. The spindle may be moved manually along the Y-axis for fine alignment of the spindle with the wheel during machine set up.

By moving the active axes in synchronism, the workpiece may be manipulated such that working gap is maintained constant and the finishing zone is moved from the center of the workpiece to the edge of the workpiece along a diameter. This motion, along with the rotation of the workpiece on its axis, can move the entire surface of lens through the working zone.

Control of the spindle arm motion may be achieved by any convenient mechanical means. The spindle arm controller may advantageously be directed by computer control.

Figure 16:
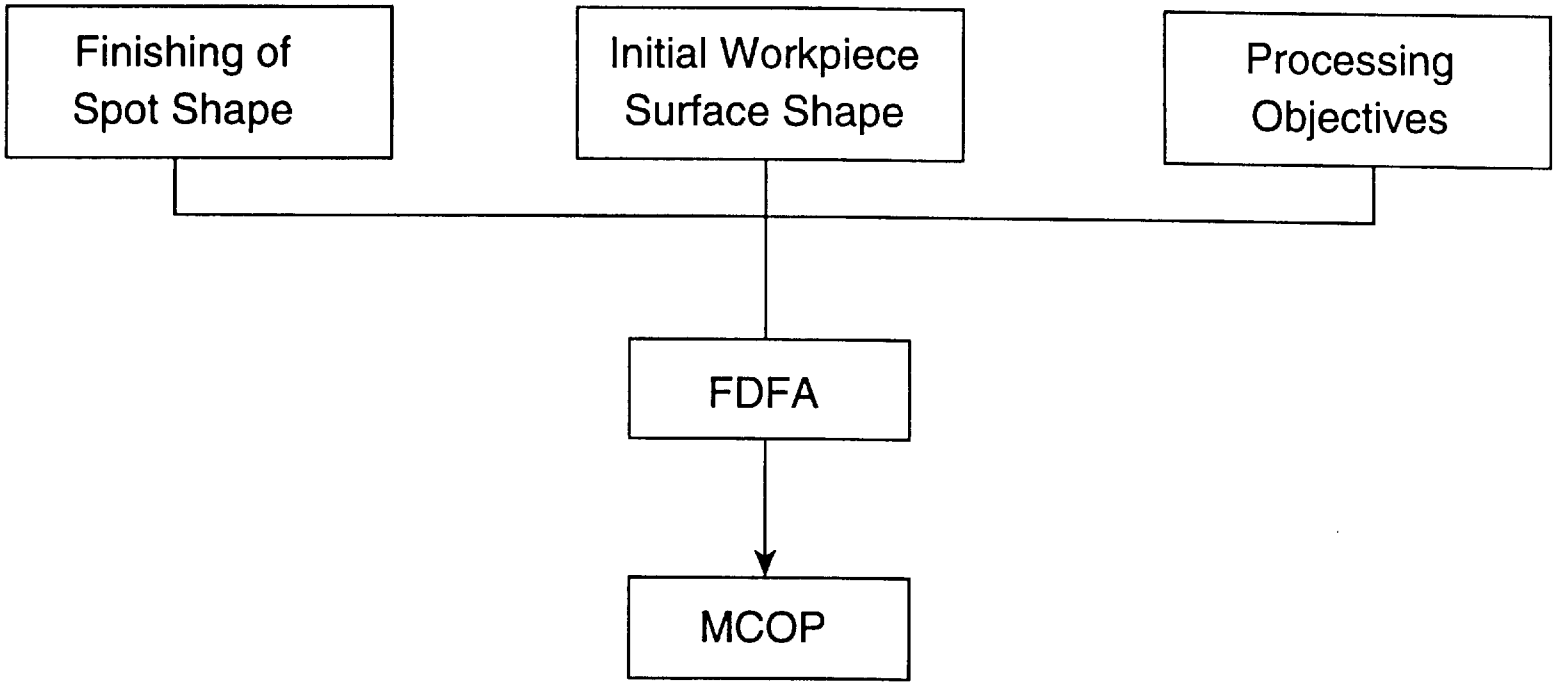
FIG. 16 is a flow chart of the computer control algorithm of the present invention.
Figure 17A:
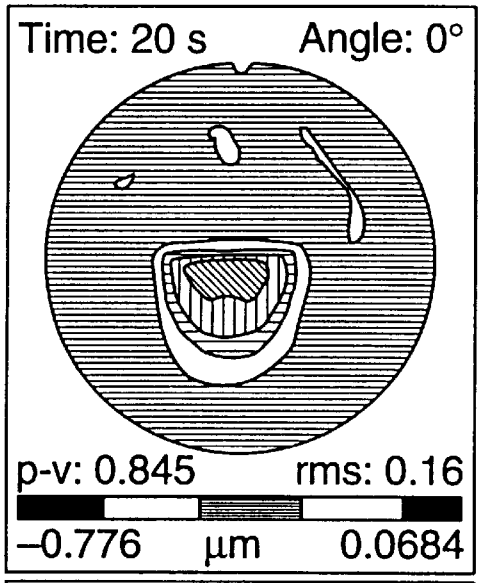
FIG. 17A and 17B are representations of the MRF removal function "spot" on fused silica.
Figure 17B:
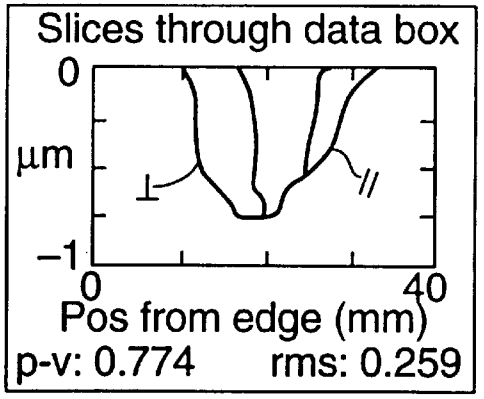
Figure 17C:
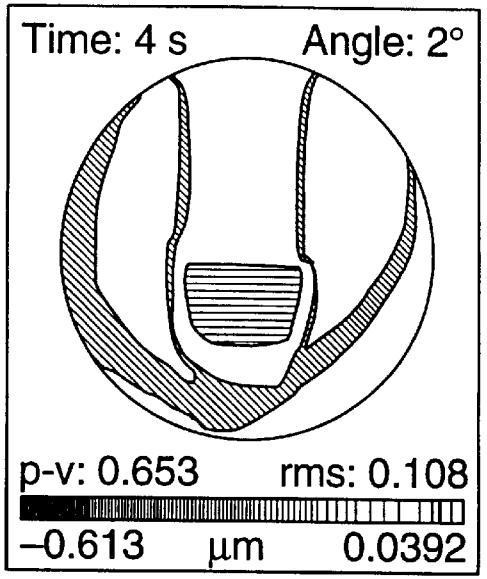
FIGS. 17C and 17D are representations of the MRF removal function "spot" on SK7 glass.
Figure 17D:
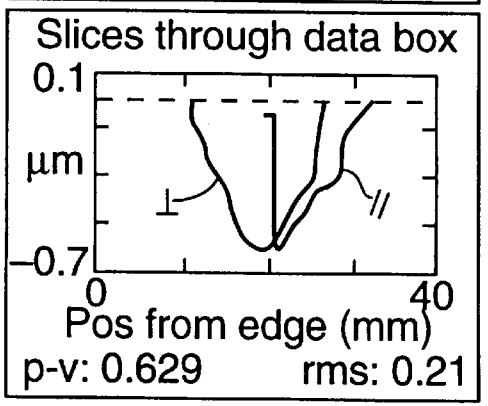

Computer controlled finishing of a part may be accomplished by the process depicted by FIG. 16. A computer code called the Forbes-Dumas Finishing Algorithm (FDFA) is used. It requires three inputs: A) the shape of and magnitude of the MRF removal function or finishing "spot", B) the initial workpiece surface shape, and C) the processing objectives, e.g. dc material removal, figure correction, or both. As output, the FDFA generates a machine control operating program, known as the MCOP. The FDFA may also generate a prediction of the residual surface figure errors that will remain in the part after processing. The MRF machine is controlled by the MCOP to effect the finishing of the workpiece.

The MRF removal function can be obtained by generating a spot on a test piece of the same material type and shape to be finished. An interferogram of the removal "spot", recorded by an interferometer like the Zygo Mark IV xp®, can be acquired and loaded into the computer control code. Alternatively, a previously recorded and stored "spot" profile may be called up from a database for use.

The finishing spot is specific to the machine platform, the magnetic field strength, the workpiece geometry, the carrier surface velocity, the MR fluid properties, the spindle/carrier surface geometry, and the properties of the material being finished. FIG. 14B shows the removal "spot" (direction of fluid motion indicated with arrows) for a 40 mm diameter, 84 mm radius of curvature BK7 glass lens, resulting from 5 seconds contact with the MR fluid at a height of 1 mm above the carrier surface. An apparatus employing a rotating trough carrier surface was used. For this apparatus, the radius from the center of the trough to the inner edge is 23 cm and the radius to the outer edge is 30 cm. The trough was rotated at 20 rpm and the magnetic field strength at the gap was 2–4 kG. The spindle arm was oriented at an angle of $\theta=2°$ and it was locked to prevent workpiece rotation. As this depth profile shows, the finishing spot has a "D" shape, with a region of peak removal at the point of deepest penetration of the lens surface into the suspension. The peak removal is 4.6 $\mu$m/minute, and the volumetric removal is 0.48 $mm^3$/minute.

The finishing spot is dependent on the material type. FIG. 17 shows interferograms of spots taken on two different glass types: fused silica and SK7. For the fused silica part., the spot was acquired by lowering the part into the suspension to a height of 1 mm above the carrier surface and at $\theta=0°$, turning the magnetic field on for 20 seconds, turning the field off and raising the part up and out of the suspension. Depth profile line scans, taken in directions parallel (‖) and perpendicular (⊥) to the direction of flow are displayed below the spot. They indicate a peak removal rate of 2.3 $\mu$m/minute for this glass. For the SK7 part, a spot is acquired by first turning on the magnetic field. The spindle-mounted part is then swept through an angle to the near-normal incidence orientation in the suspension at a height of 1 mm above the carrier surface. It is kept there for a period of 4 seconds and then swept back out. Because of its composition and physical properties, SK7 finishes faster than fused silica. The measured peak removal rate is 9.4 $\mu$m/minute. The spot shapes for these glasses are very similar. This is a characteristic of the MR process.

The second input to the FDFA in the initial surface error profile of the surface to be finished, which for a spherical surface is another interferogram showing initial deviation from a best fit sphere. For an aspheric surface the input could be a surface error profile obtained with a stylus instrument like the Rank Taylor Hobsen Form Talysurf®.

The third input is the processing objective. This could be dc removal to eliminate subsurface damage, figure correction, or a combination of the two.

The computer code combines the removal function with the initial surface shape to derive an operating program for the spindle arm angular controller on the MRF machine. The code specifies angles and accelerations of the controller, the number of sweeps required between positive and negative angles, and the total estimated processing time. Finally, the code may give a prediction for figure expected from the process cycle.

In the embodiment depicted in FIG. 1 the operating program for the spindle arm angular controller can be derived by use of a "virtual pivot point". A virtual pivot point may be determined when finishing any surface. The virtual pivot point coincides with the center of the sphere which includes the surface to be finished. The virtual pivot point is stationary relative to the workpiece for spherical surfaces. In the case of a convex workpiece the virtual pivot point will lie above the workpiece surface, whereas in the case of a concave workpiece the virtual pivot point will lie below the workpiece surface. In the case of an asphere, the virtual pivot point: will change appropriately to coincide with the local curvature of the zone being polished.

The MCOP for the spindle arm controller causes the spindle arm to move such that the virtual pivot point will remain at a predetermined location. Here, input for MCOP is the radius of curvature of the part being finished. In the case of an asphere, the asphere sag equation must be provided as an input. The virtual pivot point approach enables simulated rotation about an arbitrary point in space with three degrees of freedom. The pivot point can be constant (for spheres) or variable (for aspheres). Without a simulated or virtual pivot point, several dedicated machines would be required to perform the many tasks that can be accomplished in a single machine.

EXAMPLE 1

Table 5 presents the results of a three-cycle finishing process using the FDFA which illustrates dc removal, figure correction, and surface smoothing. The workpiece was a spheric convex fused silica part 40 mm in diameter with a 58 mm radius of curvature which was generated on the Opticam®SX.

TABLE 5

| Cycle | amount removed $\mu$m | duration minutes | figure* error $\mu$m p-v | areal** roughness Å rms |
|---|---|---|---|---|
| initial | — | — | 0.31 | 40 |
| #1: dc removal/smoothing | 3.0 | 32 | 0.42 | 8 |
| #2: figure correction | 0.7 | 6 | 0.14 | 7 |
| #3: dc removal/figure correction | 3.0 | 42 | 0.09 | 8 |

The first cycle lasted 32 minutes, removing 3 $\mu$m uniformly from the surface and reducing the areal surface roughness from 40 Å to 8 Å rms (as measured with an unfiltered, Zygo Maxim® 3D optical profiler). Symmetric surface wavefront error was held to an increase of 0.11 $\mu$m for 3 $\mu$m of material removed. A second cycle brought figure error down from 0.42 $\mu$m to 0.14 $\mu$m. This was accomplished in 6 minutes with the radially selective removal of −0.7 $\mu$m of material. A third cycle was implemented which removed an additional 3 $\mu$m of material while further reducing symmetric figure error to 0.09 $\mu$m. The final areal roughness was again 8 Å rms.

Figure 18:
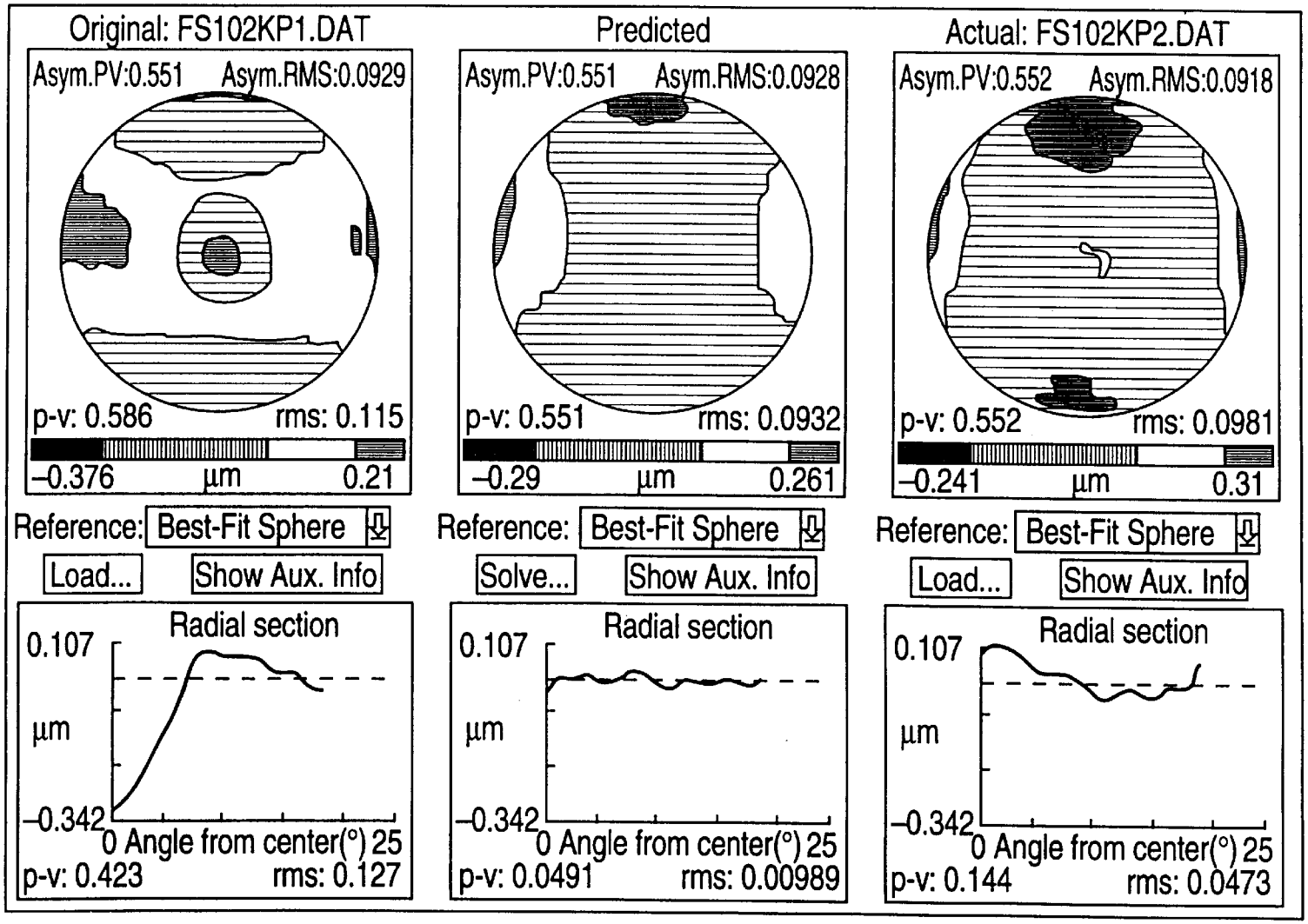
FIG. 18 is a portion of the user interface of software used in an embodiment of device for use with the present invention depicting an initial, a predicted, and an actual final interferogram of a workpiece finished in accordance with the present invention.

A portion of the Forbes/Dumas user interface for cycle #2 is shown in FIG. 18. Interferograms for the initial, predicted, and actual surface figure errors are shown at the top of the figure. Below each interferogram is a line scan representing a radial section depicting the symmetric wavefront error compared to a best fit sphere. Note that this figure correction cycle removed a hole at the center of the surface.

EXAMPLE 2

Table 6 presents the results of a two-cycle finishing process using the FDFA which illustrates dc removal and surface smoothing in cycle #1 and figure correction in cycle #2. The workpiece was an aspheric convex EK7 glass part 47 mm in diameter with 140 μm of aspheric departure from a 70 mm radius of curvature which was generated on the Opticam®SM.

TABLE 6

| cycle | amount removed μm | cycle time min | rms* roughness Å | p-v figure μm |
|---|---|---|---|---|
| initial | — | — | 9400 | 6.42 |
| #1: dc ssdd removal/ smoothing | 12 | 100 | 10 | 4.40 |
| #2: figure correction | 4 | 40 | 10 | 0.86 |

The first cycle lasted 100 minutes, removing 12 μm uniformly from the surface, reducing the areal surface roughness from 9400 Å to 10 Å rms (as measured with a Zygo New View® 20× Mirau optical profiler), and removing all subsurface damage. Symmetric surface wavefront error decreased from 6.42 μm to 4.40 μm. The second cycle brought figure error down from 4.40 μm to 0.86 μm. This was accomplished in 40 minutes with the radially selective removal of 4 μm of material. The final areal roughness remained 10 Å rms.

The finishing procedures of examples 1 and 2 were performed on an apparatus having a mechanically fixed pivot point. However, the workpiece in example 2 was aspheric, having 140 μm of departure from a spheric shape. As a result, the gap between the carrier surface and the workpiece varied during the finishing operation. Since the finishing spot did not vary in effectiveness over this aspheric surface, example 2 illustrates the relative insensitivity of the finishing spot to the height of the gap between the carrier surface and the workpiece.

We claim:

1. A magnetorheological fluid comprising non-colloidal magnetic particles, an aqueous carrier fluid wherein the pH of the magnetorheological fluid is between 7 and 11, wherein the fluid comprises about 5.7 volume percent $CeO_2$ abrasive, about 36.05 volume percent carbonyl iron, about 55.11 volume percent water, about 2.41 volume percent glycerol, and about 0.74 volume percent $Na_2CO_3$.

* * * * *